US011713168B2

(12) United States Patent
Bradley

(10) Patent No.: US 11,713,168 B2
(45) Date of Patent: Aug. 1, 2023

(54) CONTAINER WITH IRREMOVABLE CLOSURE TO FACILITATE DISPENSATION OF CONTENTS

(71) Applicant: Mark Anthony Bradley, Galway (IE)

(72) Inventor: Mark Anthony Bradley, Galway (IE)

( * ) Notice: Subject to any disclaimer, the term of this patent is extended or adjusted under 35 U.S.C. 154(b) by 0 days.

(21) Appl. No.: 17/867,480

(22) Filed: Jul. 18, 2022

(65) Prior Publication Data

US 2023/0002124 A1 Jan. 5, 2023

Related U.S. Application Data

(63) Continuation of application No. 14/818,230, filed on Aug. 4, 2015, now Pat. No. 11,390,431.

(30) Foreign Application Priority Data

| | | |
|---|---|---|
| Feb. 4, 2013 | (GB) | 1301944 |
| Apr. 6, 2013 | (GB) | 1306229 |
| Apr. 12, 2013 | (GB) | 1306672 |
| Jun. 28, 2013 | (GB) | 1311661 |
| Nov. 20, 2013 | (GB) | 1320532 |

(51) Int. Cl.

| | |
|---|---|
| ***B65D 47/06*** | (2006.01) |
| ***B65D 41/06*** | (2006.01) |
| ***B65D 51/16*** | (2006.01) |
| ***B65D 39/00*** | (2006.01) |
| ***B65D 47/36*** | (2006.01) |
| ***B65D 41/20*** | (2006.01) |

(52) U.S. Cl.

CPC ..... *B65D 47/06* (2013.01); *B65D 39/0035* (2013.01); *B65D 41/06* (2013.01); *B65D 41/20* (2013.01); *B65D 47/36* (2013.01); *B65D 51/1644* (2013.01)

(58) Field of Classification Search

CPC .... B65D 47/06; B65D 47/36; B65D 39/0035; B65D 41/06; B65D 41/20; B65D 51/1644; B67D 1/0456

USPC ..... 220/212; 215/247–249

See application file for complete search history.

(56) References Cited

U.S. PATENT DOCUMENTS

| | | | |
|---|---|---|---|
| 2,579,724 | A | 12/1951 | Breakstone |
| 3,142,409 | A | 7/1964 | Ross |
| 5,360,127 | A | 11/1994 | Barriac et al. |
| 7,077,296 | B2 | 7/2006 | Brown et al. |
| 2004/0105786 | A1 | 6/2004 | Anderson et al. |

*Primary Examiner* — Andrew D Perreault

(74) *Attorney, Agent, or Firm* — Galvin Patent Law LLC; Brian R. Galvin

(57) ABSTRACT

A container and closure combination, for the containment of fluids and extraction therefrom by way of an extraction tube. The container comprises a closed volume with an opening configured to close the opening of the container; the closure is provided with an aperture such that the closure, upon fitment to the container opening, cannot be removed therefrom. The aperture of the closure comprises a unitary elastic unidirectional valve member that can operate in a first, closed condition, to prevent a flow of fluid from the container; and a second, operational condition, with an extraction tube sealingly engaged with respect to the valve, to permit an extraction of fluid from the container through the tube.

2 Claims, 48 Drawing Sheets

(PRIOR ART)

(PRIOR ART)

(PRIOR ART)

(PRIOR ART)

D - D

CONTAINER WITH IRREMOVABLE CLOSURE TO FACILITATE DISPENSATION OF CONTENTS

CROSS-REFERENCE TO RELATED APPLICATIONS

This application is a continuation of international (WIPO) patent application serial number WO 2014/118628, titled "CONTAINER WITH IRREMOVABLE CLOSURE TO FACILITATE DISPENSATION OF CONTENTS" and filed on Feb. 3, 2014, which claims priority to GB1301944.3, titled "IMPROVEMENTS IN OR RELATING TO CONTAINER CLOSURES" and filed on Feb. 4, 2013, and to GB1306229.4, titled "IMPROVEMENTS IN OR RELATING TO CONTAINER CLOSURES" and filed on Apr. 6, 2013, and to GB1306672.5, titled "IMPROVEMENTS IN OR RELATING TO CONTAINER CLOSURES, and filed on Apr. 12, 2013, and to GB1311661.1, titled IMPROVEMENTS IN OR RELATING TO CONTAINER CLOSURES" filed on Jun. 28, 2013, and to GB1320532.3, titled "IMPROVEMENTS IN OR RELATING TO CONTAINER CLOSURES" filed on Nov. 20, 2013, the entire specifications of each of which are hereby incorporated by reference in their entirety.

BACKGROUND OF THE INVENTION

Field of the Art

The present invention relates to containers that are used to contain fluids that need to be dispensed in controlled quantities. In particular, the present invention relates to a container closure, which can be readily and securely fastened to dispensing containers, bottles and the like.

Discussion of the State of the Art

In many fields of endeavor, barrels, plastics containers, cans and other fluid containers are employed to enable the safe storage of a fluid. The fluids contained in the containers may be suitable for a single or several uses and can comprise fluids such as oils, fuels, chemicals, and cleaning fluids. Consider a utilities manager of a manufacturing facility. The floor of the manufacturing area has to be cleaned thoroughly because of greases etc. that are dropped; in order to maintain safety and productivity, the floor has to be cleaned using rotary scrubbing machines, which apply a liquid cleaner, followed by the use of liquid vacuum machines. The scrubbing machines will have a tank that is filled with, for example, water and a degreasant chemical. A particular dose of degreasant chemical is added to the water tank of the scrubber prior to use. The amount dispensed is conveniently provided by way of a hose with a dispensing function and is attached to the container. Upon filing of the cleaning tool, there is no wastage—especially if compared with the use of a cup by an operator with a gloved hand and scooping a required amount from an open container. Not only is wastage minimized, proper cleaning is effected, using the required dosage, whereby to satisfy onerous health and safety recommendations, for example. It will be appreciated that in certain industries such as that of medical device manufacture, drug manufacturing and food production, that there will be mandated standards of cleaning mandated. By the use of prescribed amounts of chemical per unit of solvent—typically water—then national standards/site standards can be maintained.

For example, chemicals currently used in the commercial cleaning industry or any industry are typically stored in standard blow mortgage containers, for example, 5-liter (1 gallon) containers. FIG. 1*a* shows a standard type of prior art 5-liter container. The container is blow molded, with an integral handle and a screw-top opening at for screw-threaded connection with a lid. The container caps use standard screw fittings, which can be fully removed for filling and dispensing from the bottle; different specific types of container open can exist for different sizes of container, such as the prior art 20 liter and 200 liter containers shown in FIGS. 1*b* and 1*c*. When a chemical container is connected to a dispenser, the cap is fully removed and a flexible tube from the dispenser is inserted into the neck of the bottle. If a user wishes to dispense cleaner directly from the bottle rather than via the dispensing system there is nothing restricting this practice. It is also reported that certain households benefit from the decanting of specialized fluids into proprietary household containers. Indeed, there are many detergents that are used for several tasks, for example, and may be suitable for the general cleaning of all floors, walls and cladding, washable hard surfaces, including all paintwork and types of motor vehicles and even for garments. Such products can be decanted for unauthorized personal use.

In another field, greases and oils will need to be dispensed in a workshop; sometimes additives must be accurately dispensed; the product can be expensive. With reference to FIG. 2, there is shown a proprietary prior art system 20 for transporting and dispensing fluid from a single drum 22 or small container; an uppermost cap—when the barrel is standing in an upright fashion is simply enabled to be at the lowermost point when resting in a horizontal position—but not shown in the figure. Systems such as this can be adapted to catch spillage.

Bottles/containers containing automotive lubricants, household chemicals, agricultural products and the like are ill equipped to dispense without additional dispensing device. Exterior dispensing devices on the market (e.g. funnels, valves, tubes) are limited in value. They are typically rigid, i.e. not adaptable or flexible; they are typically restricted in length/range, e.g. regarding motor oil, a funnel flask can dispense into an engine's crankshaft, but cannot reach the transmission intake; they typically require cleaning and storage for reuse, i.e. the value relates to the number of possible uses and accessibility; and they are sold separately from the bottle/container, e.g. when a consumer purchases motor oil, outside of having a funnel readily available, the consumer cannot effectively dispense the oil.

In addition to the dispensing of fluids, containers must also be housed and stacked in appropriate conditions. Businesses routinely store and move a variety of potentially polluting materials in containers ranging in capacity from a few liters up to drums of 205 liters (45 gallons) and 1000 liters (219 gallons) industrial bulk containers (IBCs). These containers must be stored in accordance with appropriate legislation.

Containers of oil, chemicals or other potentially polluting materials can pollute surface water and groundwater. Pollution can be caused by spills from several sources, such as the incorrect storage and handling of containers; accidental leaks; vandalism and theft; overfilling or failure of storage structures; run-off from fires and contaminated firewater; incorrect or damaged drainage systems. These are all potential hazards. Additionally, there are many substances that aren't harmful to humans but that will cause pollution if they're spilt, for example liquid food and drinks, detergents and paper sludges. For example, in England and Wales, oil storage is regulated by the Control of Pollution (Oil Storage) (England) Regulations 2001, (OSR England). Oils covered by these regulations include petrol, diesel, vegetable, synthetic and mineral oils. The regulations apply to most industrial, commercial and institutional sites storing oil outside in containers over 200 liters, including drums and IBCs and to domestic premises storing more than 3500 liters.

In the field of containers for food and drink, similar issues can occur in the control of dispensing of fluids, pastes, creams, emulsions and powders. The dispensing of condiments is one issue tomato ketchup, salad dressings, mayonnaise etc. Restaurants and the like will wish to buy in bulk and have dispensing means that allows correct dispensing to be enabled and reduce levels of pilfering. Similarly, sports drinks can be consumed with a straw—but for the container that non-sealingly allows a straw or tube to be inserted the drink cannot be consumed without spillage unless special care is taken.

Thus, known container and dispenser systems do not necessarily provide security and none are adapted to the acceptance of "universal" tube vacuum dispensing devices and/or are complex to utilize. Caps and similar closure systems for containers in production and in use to date, are designed to re-open after being attached with respect to a container.

The present invention seeks to provide a solution to the problems addressed above. The present invention seeks to provide a container closure that readily adapts to dispensing requirements, which can readily and easily be manufactured, at low cost.

SUMMARY OF THE INVENTION

In accordance with a general aspect of the invention, there is provided a cap for fitment to a container, wherein the cap becomes irreversibly attached to such a container and has an aperture for the insertion of a tube whereby controlled delivery of a fluid from the container can be enabled. The apertured cap preferably comprises one of a screw cap, a push-fit cap, having detent or glue applied thereto, for a male or female opening associated with the container. In such an arrangement, the cap can be manually attached or fitted in a no-wear or low wear mechanized process. It will be appreciated that in the attachment of some types of closure, expensive machinery is required to fasten, for example metal flanges to containers, which machines typically require re-tooling after wear, arising from the creation of welds or rolled flanges to connect the two parts together in a sealing relationship.

In accordance with a specific aspect of the invention, there is provided a container and closure combination, for the containment of fluids and extraction therefrom by way of an extraction tube, the container comprising a closed volume with an opening, the closure being configured to close the opening of the container, wherein the closure is provided with an aperture and wherein the closure, upon fitment, cannot be removed from the container opening, the aperture of the closure being defined by a unitary elastic valve member permitting unidirectional flow of fluid through the aperture; wherein the valve can operate, interchangeably, between: a first, closed condition, to prevent a free flow of fluid from the container; and, a second, operational condition, with the extraction tube sealingly engaged within the valve, to permit an extraction of fluid from the container through the tube. By having a unitary, elastic valve member, the valve can conveniently be manufactured with the closure in a simple manufacturing process e.g. in what is known as a two-shot process, whereby the inner valve is manufactured from an elastic plastics material, with the outer surround/container engagement portion being manufactured from a more rigid plastics material.

The present invention can comprise not only the container and closure with aperture but also a tube. For example, the invention may comprise a sports drink with the apertured closure together with a tube. The tube can function as a straw, whereby a drink such as a sports drink can conveniently be consumed, the cap preventing tainting of the drink replacement thereof, which could be useful in competition settings, for example, to ensure uniformity in provision of drinks. The tube can comprise a paste/sauce siphon/vacuum dispensing means or be associated with a paste/sauce siphon/vacuum dispensing means whereby a condiment such as a ketchup, mustard etc., can be dispensed.

Conveniently, the apertured closure or cap is irreversibly fastened to a container by means of co-operating detent mechanism, similar to the frangible devices that indicate that an apertured closure has been removed associated with many consumer products (save that the detent item is not frangible and prevents removal of the apertured closure). Other methods of irreversible attachment could also be employed, such as one-way, push fit aperture closures using barbs from one part physically engaging a relatively softer surface of the other part of the container opening and apertured closure combinations or by having a reverse friction effect, thereby preventing removal. The respective parts of the combination could also be irreversibly or permanently attached by means of adhesive—glue or solvent—or by heat welding. Simple mechanical ratchet one-way locking systems can also be employed and other more sophisticated mechanical one-way systems. After the closure cap has been securely attached, it is ready for an appropriate format of dispensing tube to be inserted to extract the fluid contents. This apertured closure security feature eliminates the misuse of fluid contents in a simple and cost effective way. The apertured closure of the present invention can simply and effectively prevent an abuse of contents, spillage, pilferage, wastage and cross-contamination.

The apertured closure of the present invention can conveniently be manufactured by well established techniques of injection molding together with over molding, whereby to maintain production costs at acceptable levels, comparable to the manufacture of known cap closures.

In another aspect of the invention, there is provided a container and closure with aperture combination, the container comprising a closed volume with a generally circularly shaped rim or opening, the apertured closure comprising a closure element having an inside portion for abutment with the rim, to sealingly engage therewith, a wall portion depending from the inside portion having cooperating means to securely locate with rim of the container, the outside wall of the apertured closure surrounding the outside apertured closure; wherein the apertured closure is defined with an indentation leading to a closable seal, the seal being operable to accept a tube of a dispensing apparatus.

Once securely located with the container, the apertured closure cannot be removed without damage to either the container or closure from the container, thereby preventing any unintentional or accidental dispensing of the fluid in the preparation of cleaning preparations, lubricant mixtures etcetera, where fluids need to be dispensed in measured quantities. In a simple example, a standard container for a cleaning fluid could be controlled by the use of the present invention whereby a dispenser can be used to allow metered amounts of an additive to water for a cleaning process; by having a tube associated with the dispenser then the correct metered dosage may be provided, saving waste; accidental over-pouring is prevented. Preferably, upon first mating of the apertured closure and container, they become irreversibly fastened each to the other. In the prior example, the closure can be simply fastened by hand tightening. Additionally, by having the apertured closure secured in a non-removable fashion, removal of fluid from a container with such an apertured closure by unauthorized persons is prevented, in a simple fashion. Additionally, this can provide significant advantages in the safe disposal of toxic or otherwise undesirable fluids; since any remaining fluid cannot be removed and the container and apertured closure combination cannot be re-used, the container and apertured closure combination must be disposed of, conveniently through safe/authorized channels.

The cooperating means may comprise mutually engaging screw threads or mutually engaging bayonet fastening elements. The cooperating means may comprise detent means, whereby, for example, a clip associated with the apertured closure overlies a detent means, such as a collar about the aperture associated with the container. Such a detent system means that the aperture need not be limited to a circular opening, as required by a rotationally fitted connector.

The apertured closure could also be secured by an adhesive, in the event that the cap was an original fitment. Contoured apertured closures could be fitted whereby the apertured closure and container could only operate with corresponding dispensing apparatus.

Preferably, the seal can comprise a two-flap arrangement (also known as a "duckbill seal"), or multi-flap variants thereof. The seal member can have a tube feed-in section that is of a general conic shape, having a spiral wire element molded therein to provide a degree of ruggedness. A duckbill seal can be adapted so as to seal with generally rectangular conduit tubes. The seal, when opened with a tube for dispensing can also provide space for air to pass into the container, since dispensing means typically use vacuum forces to enable passage of fluid, a partial vacuum within the container will reduce the amount of a dispensed quantity. In the alternative, a gastight seal may be provided as between a tube and the cap, as might be required for certain classes of fluids, when the central seal is required to be airtight. For example, the aperture may define a ring of an approximate dimension slightly less than the dimension of a tube through which aperture the tube will be connected, whereby the seal, in use is gastight or fluid-tight. Additionally, the close fitting could remove any fluid that may be present upon the exterior wall of the tube as the tube is extracted. The rim of the aperture may be reinforced by the provision of an enhanced amount of polymeric/rubber material about the aperture, preferably further reinforced with a closed loop defined by a spiral spring, whereby a greater degree of strength is provided to the aperture. Additionally, a one-way valve could be provided to enable pressure compensation to occur e.g. by the provision of air, whereby to prevent vacuum problems arising in any dispensing of the fluid.

It will be appreciated that when a fluid tube is inserted into a container, which will generally have an aperture directed upwardly, that the weight of dispensed fluid in the tube will increase the weight of the tube and thus cause forces to act upon the seal, tending to induce the aperture to a degree of ovality (for a nominally circular tube or conduit). Accordingly, in another aspect of the invention, there is provided a centralizing aperture, located at the top of the apertured closure (as seen from the user, when in normal use, with the apertured closure at the top of a fluid container). The centralizing apertures may comprise a further polymeric member with an aperture or a device akin to an iris diaphragm, whereby the strain from the weight of the tube and fluid therein is borne by this first, upper aperture.

The present invention can be utilized in, for example, a stores department of a company, to ensure that fluids are utilized only with respect to their prescribed uses. In such cases, the cap is fitted after the container is initially opened, with any protective seal removed. Additionally, a container may be supplied with an apertured closure in accordance with the present invention, together with a stopper whereby to prevent loss of fluid in transit where a dispensing tube is inserted, in use, whereby to prevent loss of fluid in transit prior and subsequent to extracting fluid from said container.

In accordance with another aspect of the invention, there is provided an apertured closure for use with a container. The apertured closure can be screwed-in, clipped-on or otherwise retained to ensure that the apertured closure cannot be removed whereby to enable good stock control and/or effective dispensing of liquids within a container. Upon disposal, the provision of a bung can assist in closure of the aperture for a dispensing tube, whereby the container can be appropriately disposed of through official channels. The bung can be fitted in an irremovable fashion, though a detent, a one-way screw thread or otherwise. Whilst the invention has been described as a unitary integrally molded closure and valve combination, it is possible that these are arranged as separate items.

The present invention thus provides a simple to fabricate container stopper, which can enable satisfaction of security, health and safety requirements that are imposed on all types of businesses as well as increasing compliance with rules and regulations that are seen by some as a hindrance to normal business practice. Additionally, certain industries involved with medical device manufacture, drug manufacture and food production, etc. have additional mandated standards regarding control of fluids with the use of dispensing equipment. The present invention can assist in compliance of such further standards.

Thus, in summary, the present invention can provide an easy to use cap that once fitted to a container cannot be removed for the placement of tubes associated with vacuum/siphons associated with dispensing means and tubes as in straws for drinking from a bottle. Fluids for all uses from any type of container or receptacle whether it is a bottle, drum, tin, can, bag or box, through a dispensing means such as a tube, syphon, straw, syringe, hose or pipe.

BRIEF DESCRIPTION OF THE DRAWING FIGURES

The accompanying drawings illustrate several embodiments of the invention and, together with the description, serve to explain the principles of the invention according to the embodiments. It will be appreciated by one skilled in the art that the particular embodiments illustrated in the drawings are merely exemplary, and are not to be considered as limiting of the scope of the invention or the claims herein in any way.

FIGS. 1*a*-1*c* (PRIOR ART) illustrate three prior-art containers;

Figure 13A:
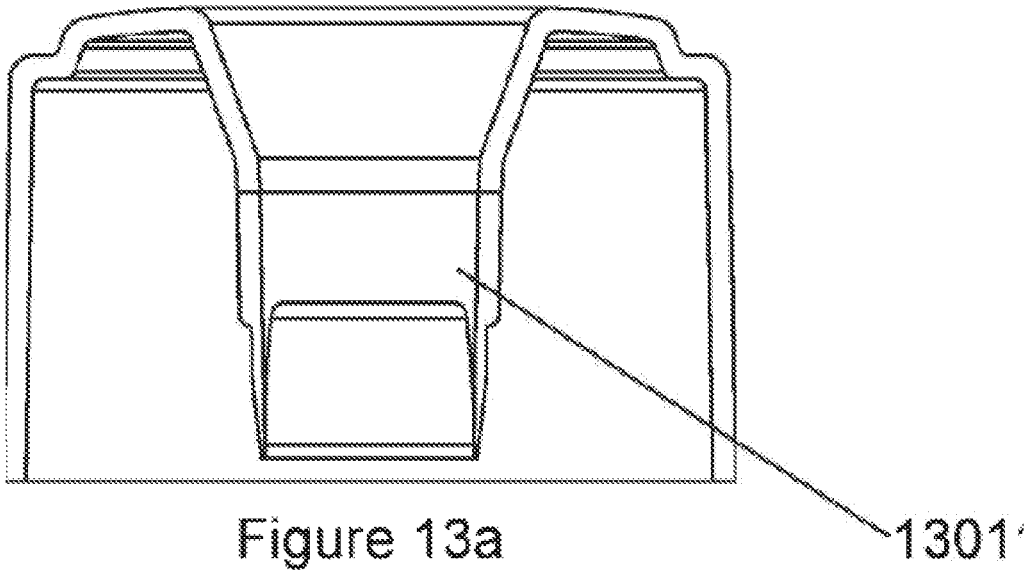
Figure 13B:
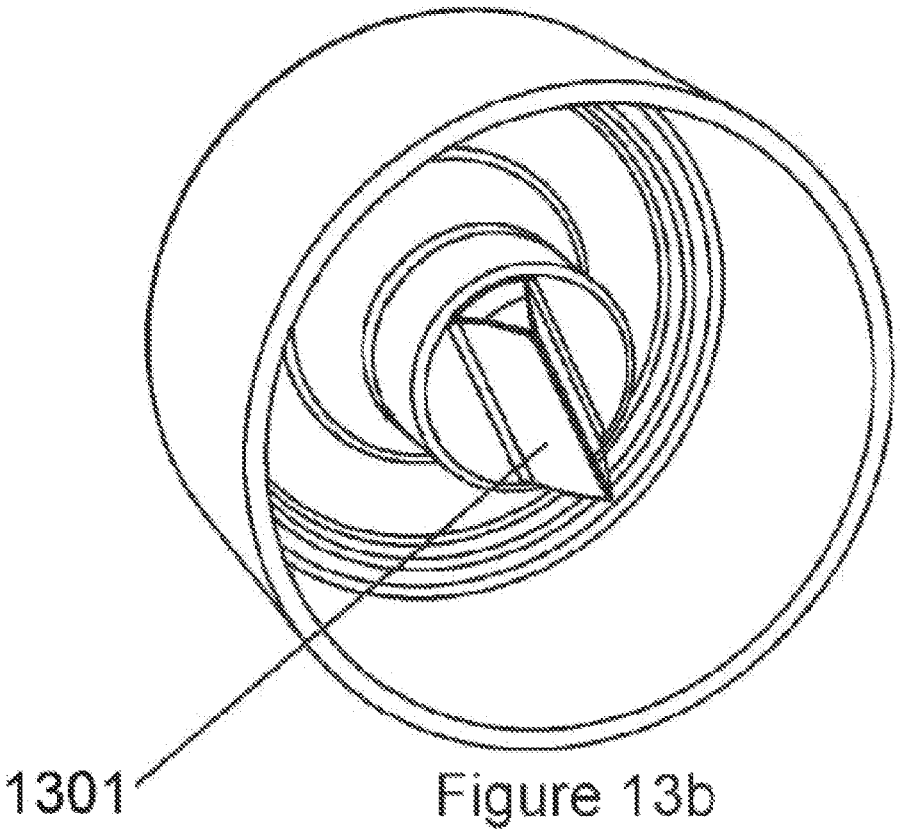
Figure 14:
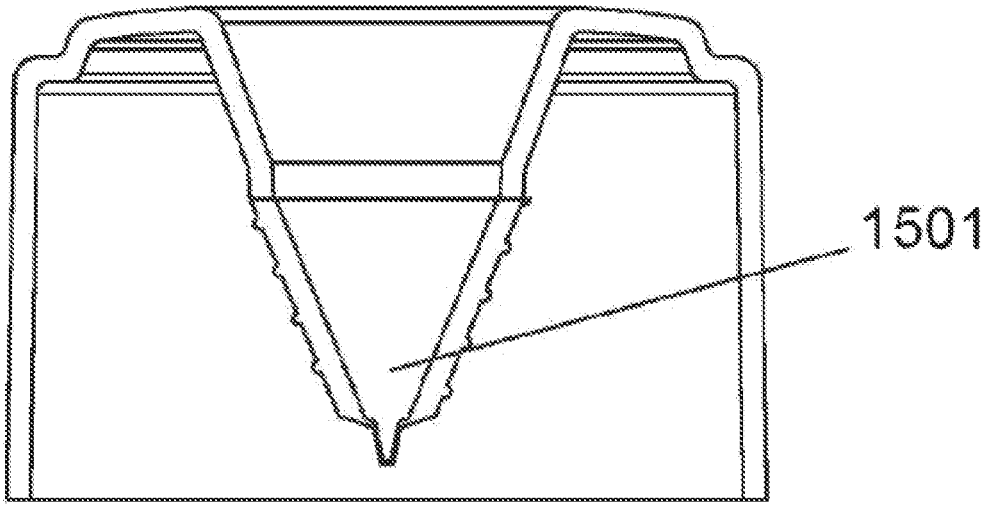
Figure 15:
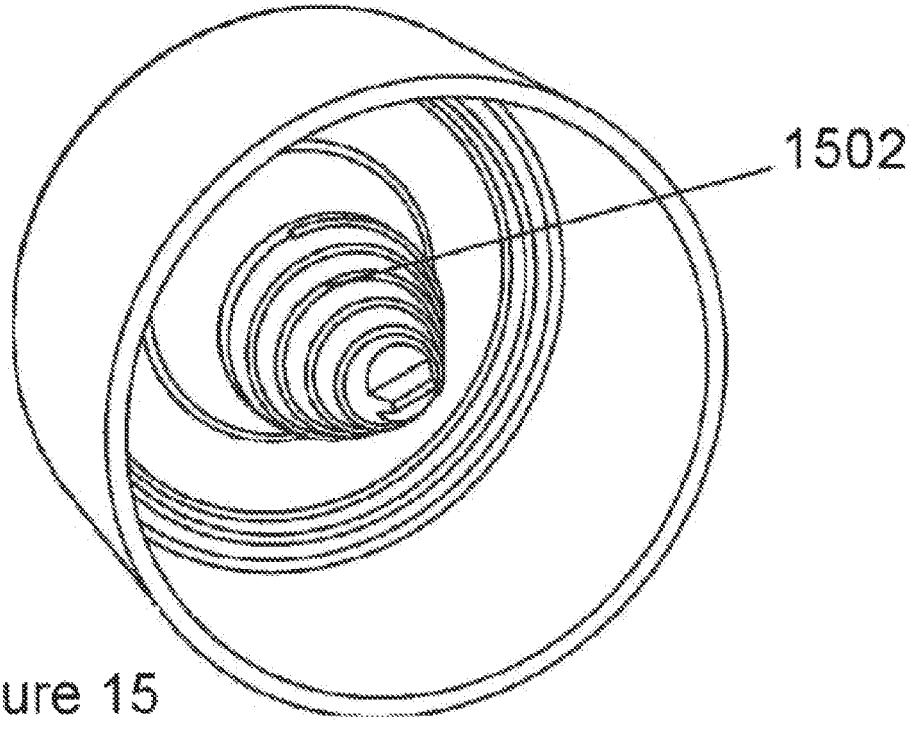
Figure 16A:
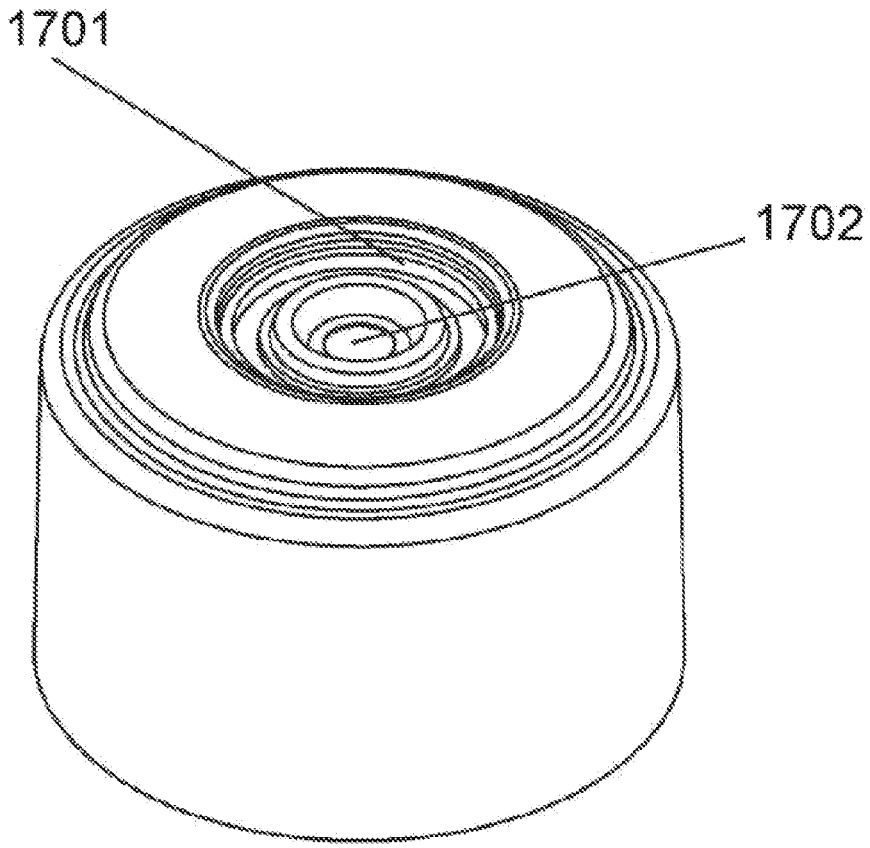
Figure 16B:
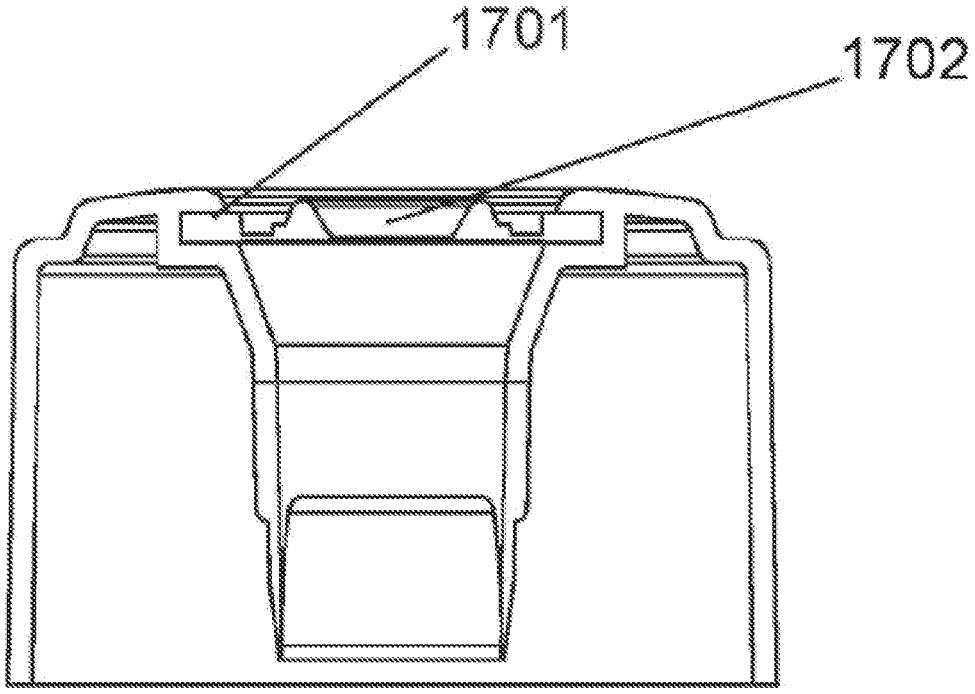
Figure 17A:
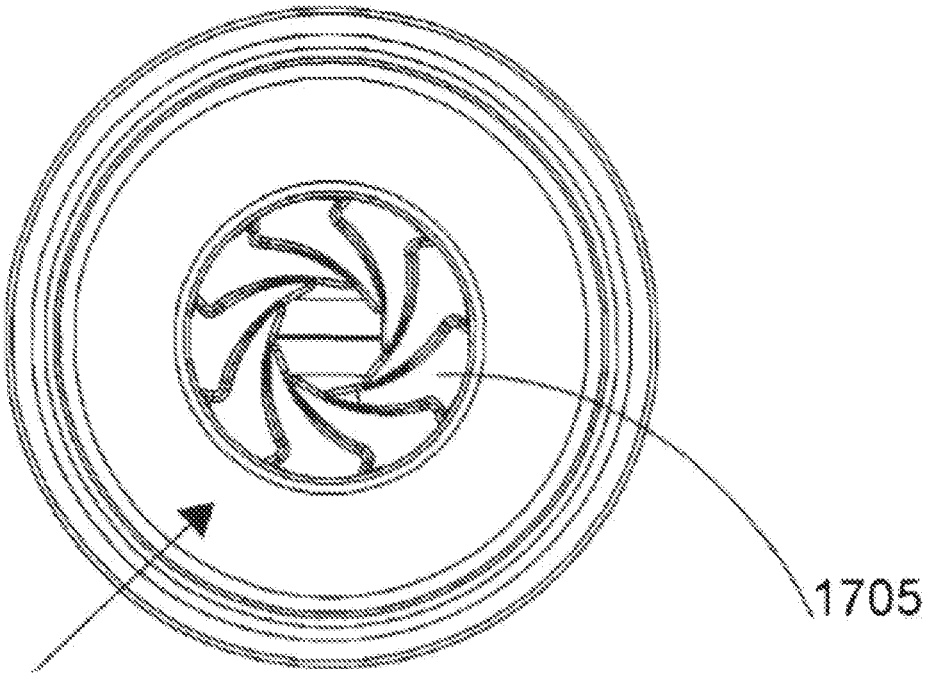
Figure 17B:
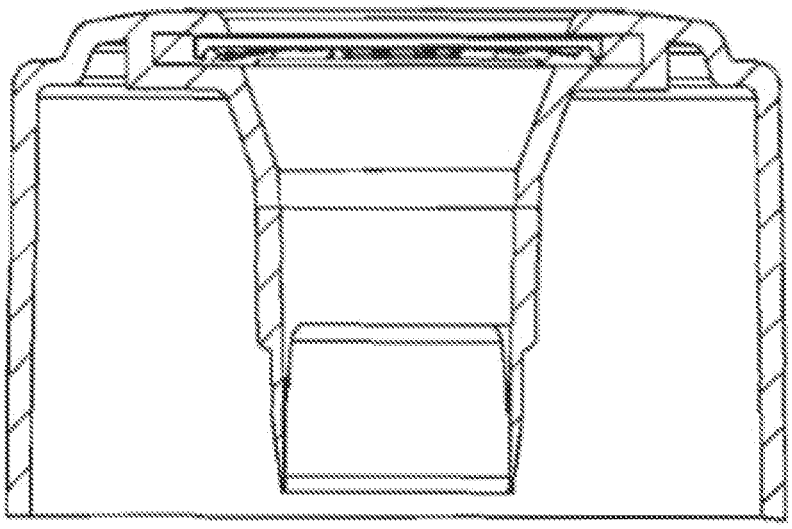
Figure 17C:
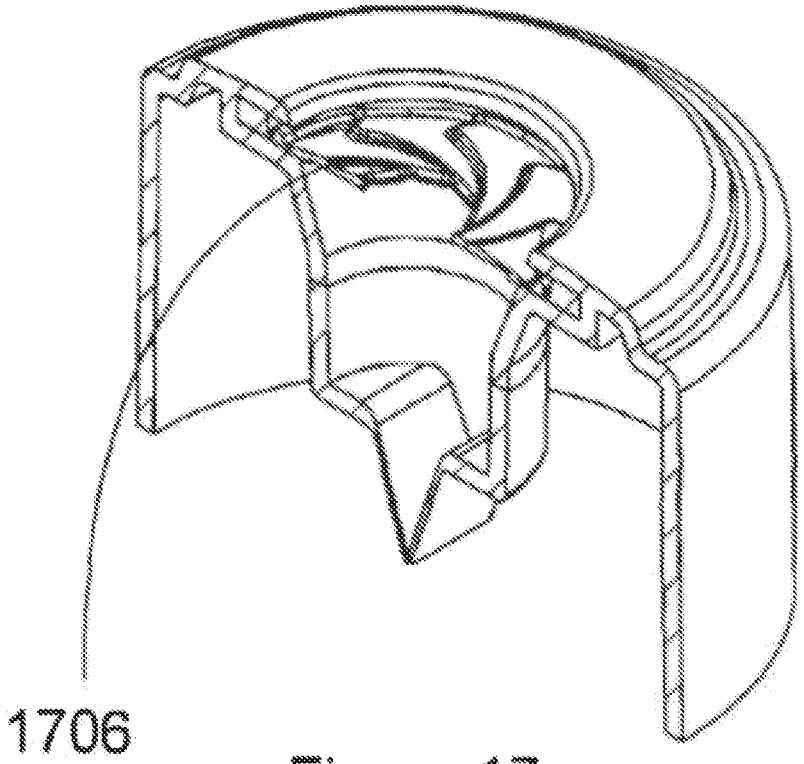
Figure 19:
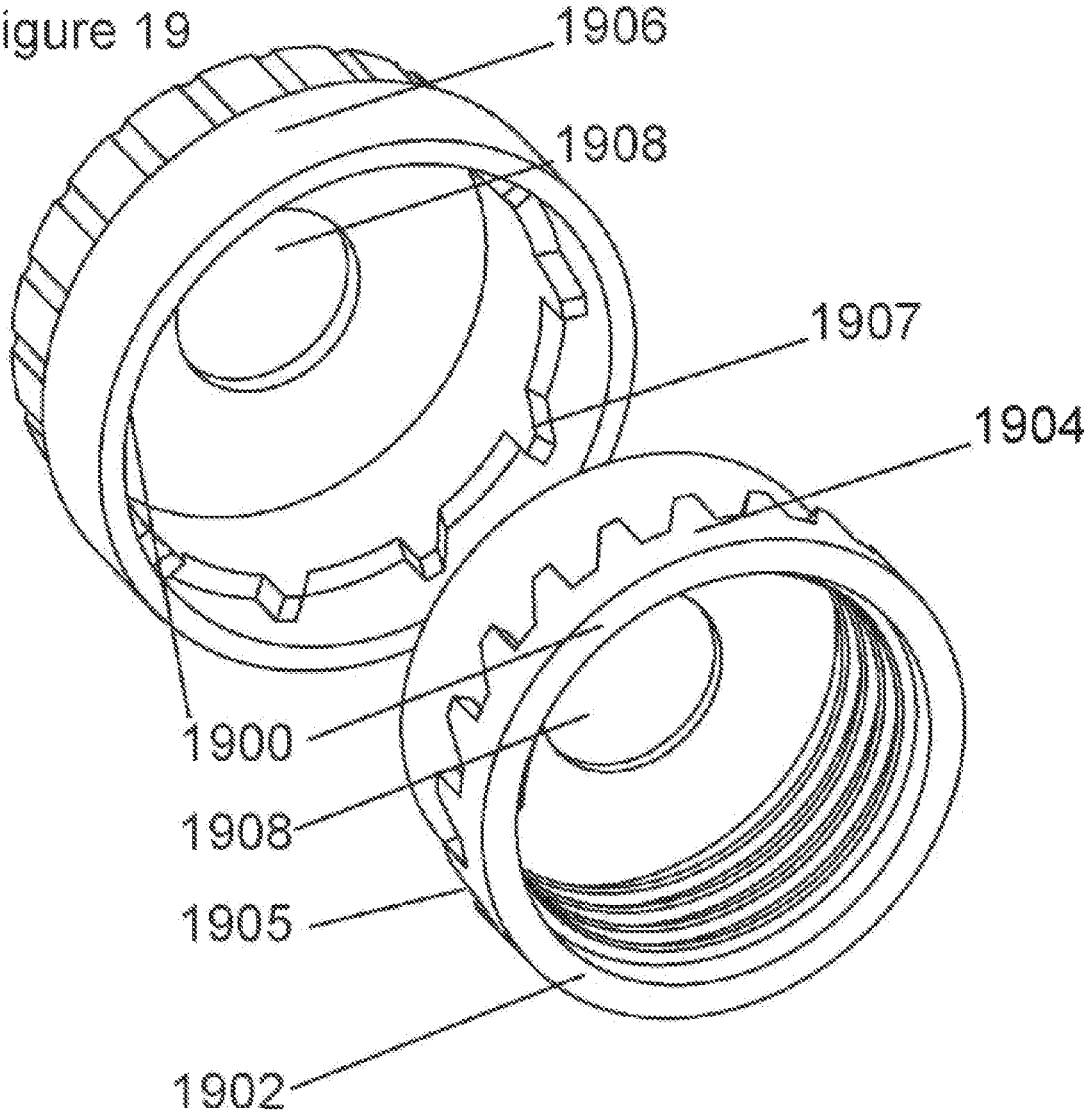
Figure 20:
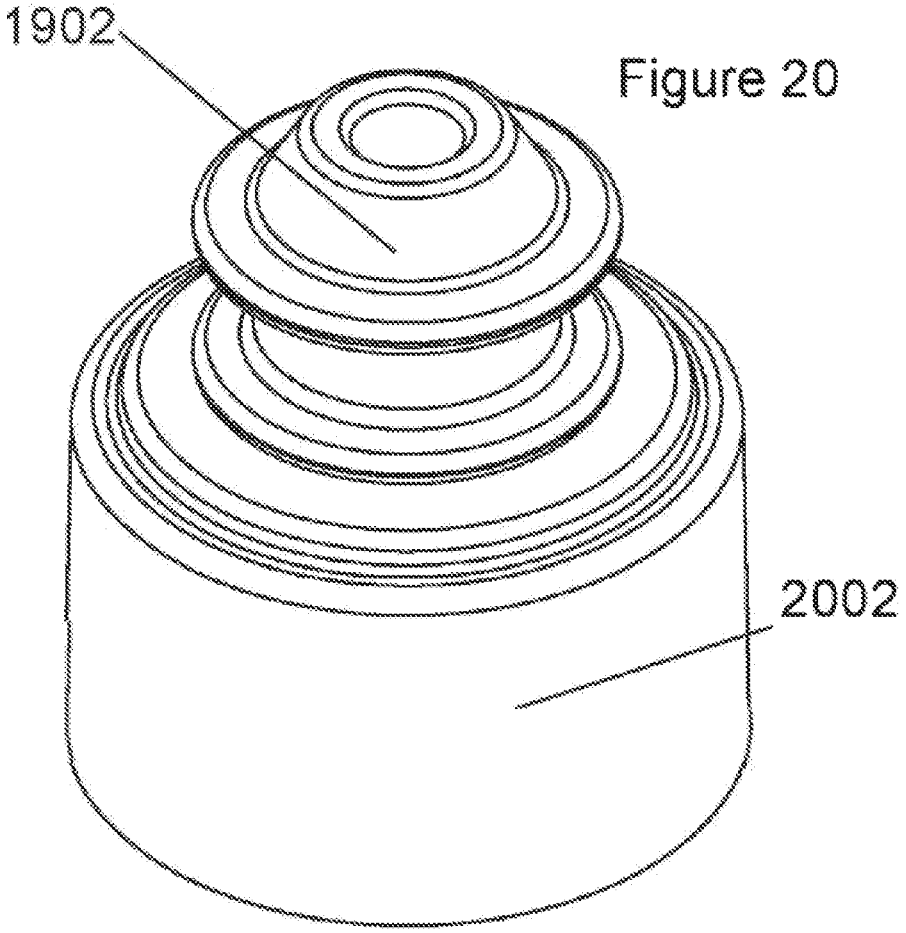
Figure 21A:
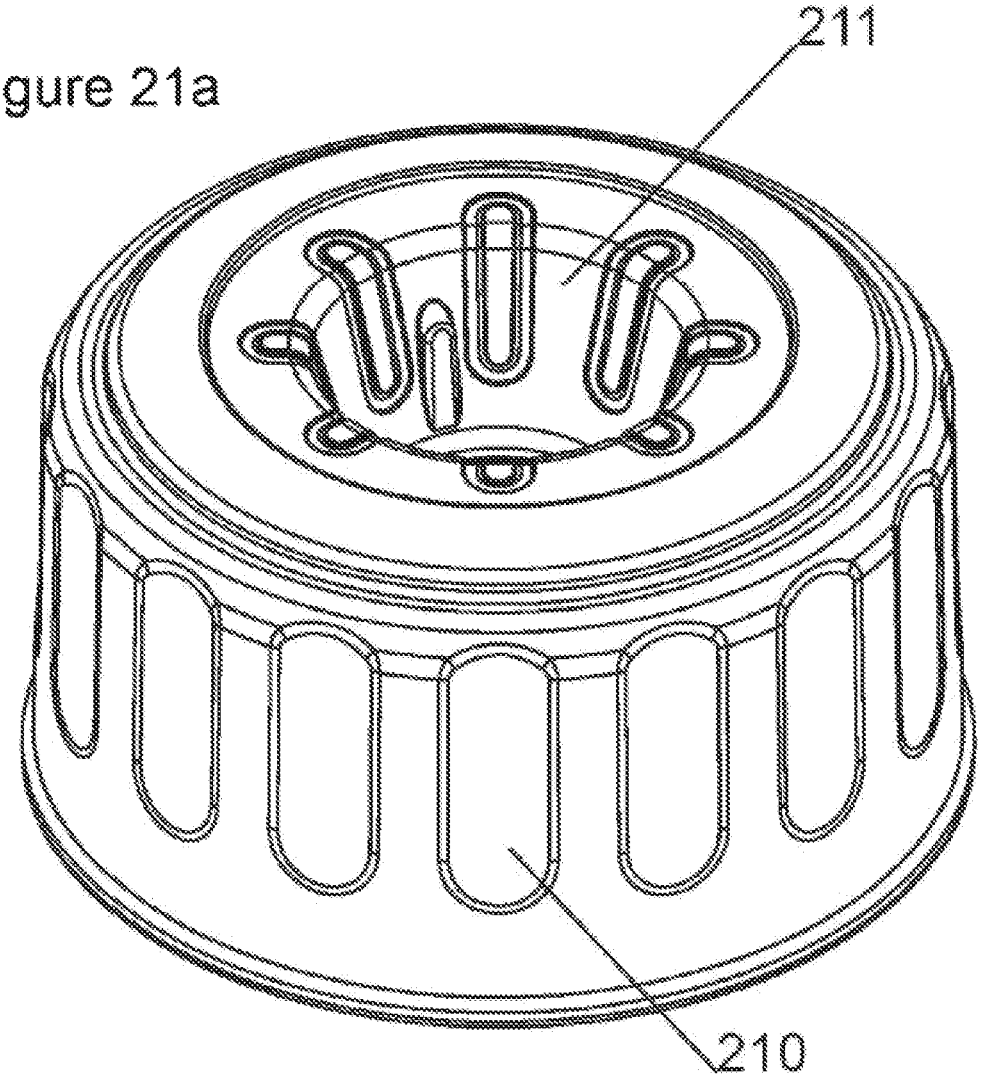
Figure 21B:
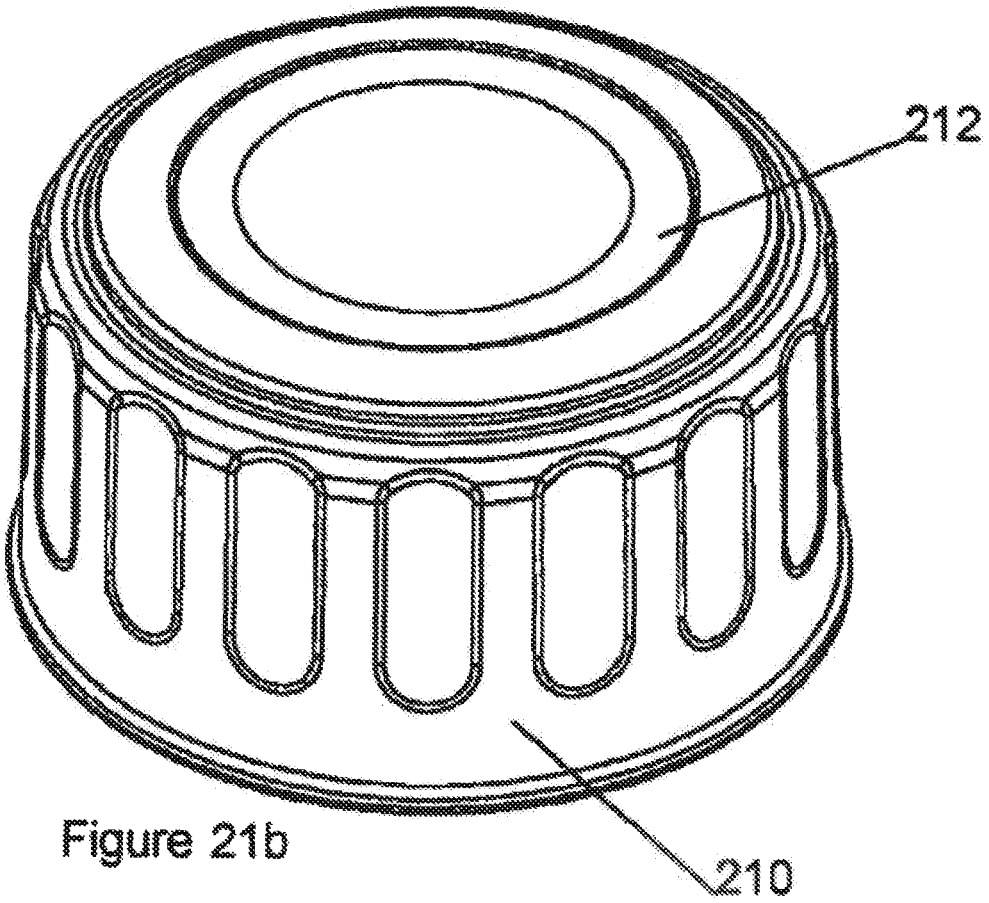
Figure 21C:
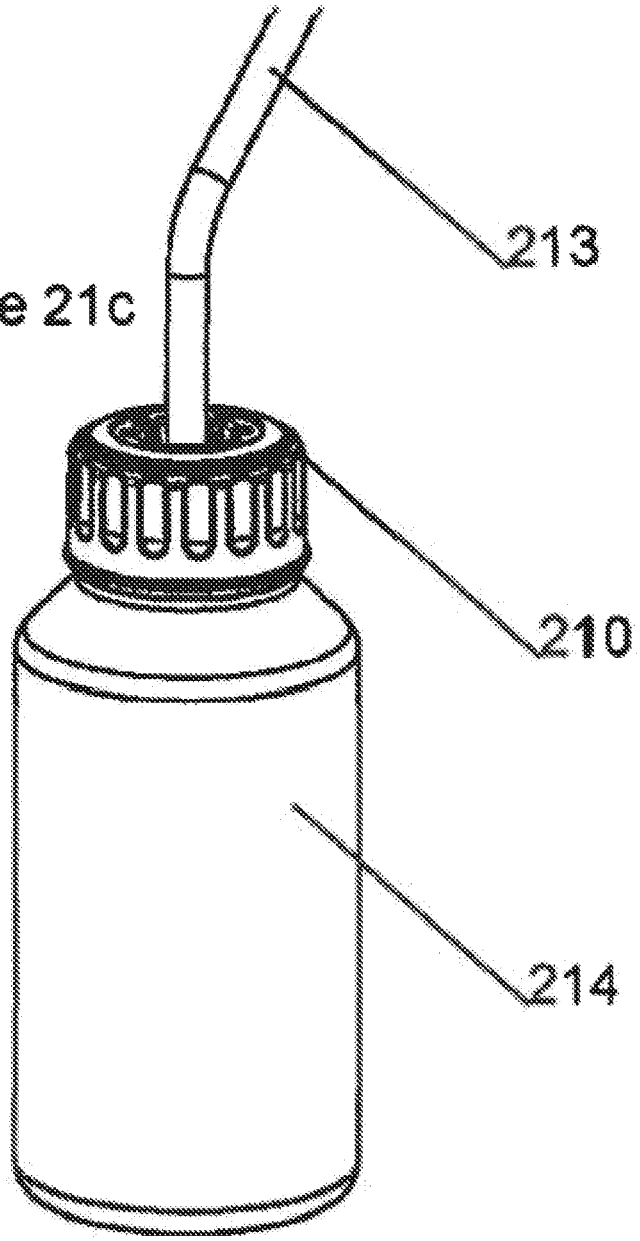
Figure 22:
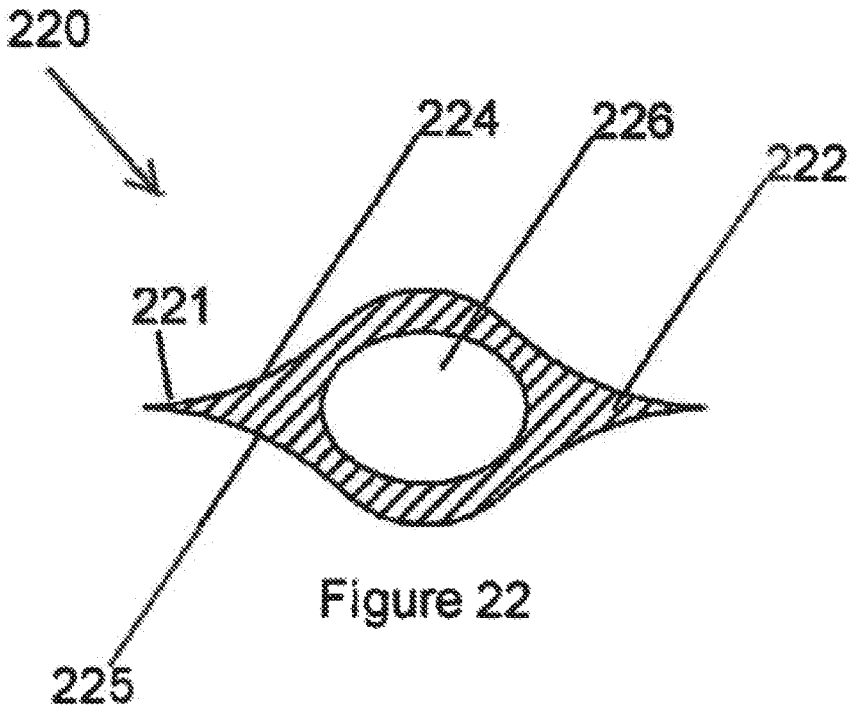
Figure 23:
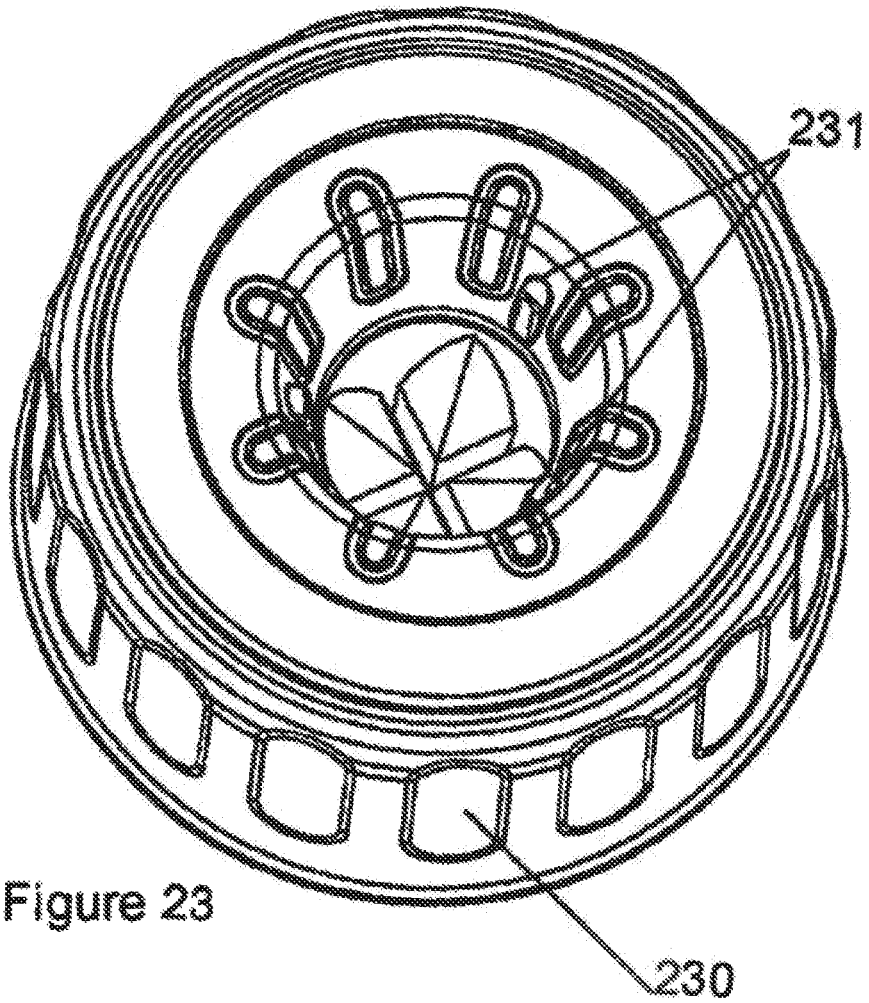
Figure 24A:
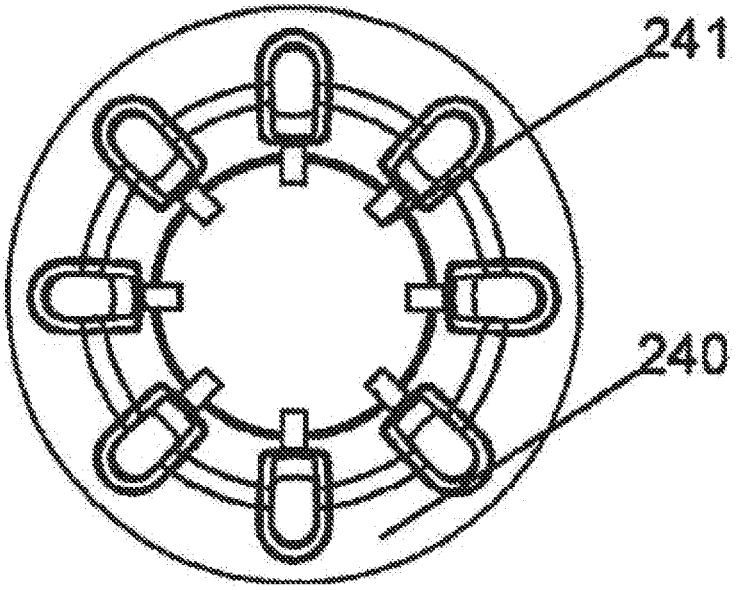
Figure 24B:
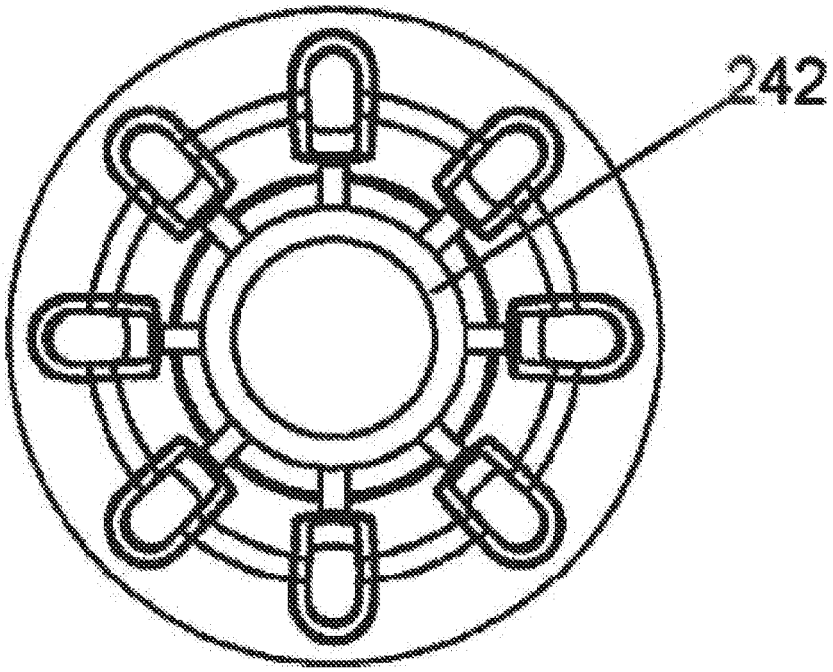

FIGS. 12*a*-12*j* relate to a further aspect of the invention;

FIGS. 13*a*-13*b* show a further variation of the invention;

FIG. 14 shows a still further variation of the invention;

FIG. 15 shows another embodiment of the invention;

FIGS. 16*a*-16*b* show a first strain relief assembly closure;

FIGS. 17*a*-17*c* show a second strain relief assembly closure;

FIGS. 18 *a*-18*e* show methods of forming permanent connection between a closure device and an opening;

FIG. 19 shows one form of unidirectional screw-on-can't-screw-off apertured closure in accordance with the invention;

FIG. 20 shows a bung in accordance with a further aspect of the invention;

FIGS. 21*a*-21*b* show an aperture closure in accordance with another aspect of the invention with and without a cover;

FIG. 21*c* shows a container and cap combination together with drinking straw inserted;

FIG. 22 shows a cross-section of a tube in accordance with another aspect of the invention;

FIG. 23 shows a perspective view of a further embodiment in accordance with another aspect of the invention; and, FIGS. 24*a*-24*b* show plan view of alternative configurations of the further embodiment of FIG. 23.

DETAILED DESCRIPTION

There will now be described, by way of example only, the best mode contemplated by the inventor for carrying out the present invention. In the following description, numerous specific details are set out in order to provide a complete understanding to the present invention. It will be apparent to those skilled in the art, that the present invention may be put into practice with variations of the specific. For the avoidance of doubt, the term closure refers to devices used to close or seal a bottle, jug, jar, tube, can, container, barrel, keg etc. Closures can be a cap, cover, lid, plug, bung, etc.

Figure 1A:
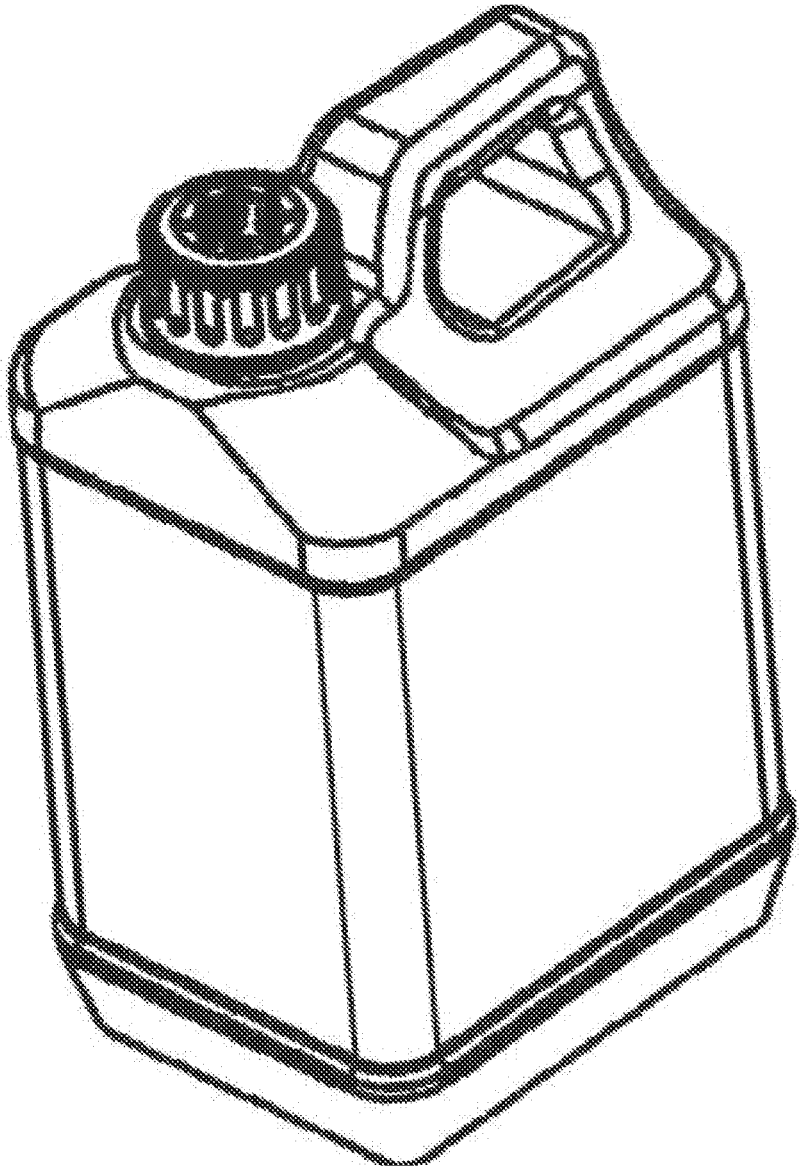
Figure 1B:
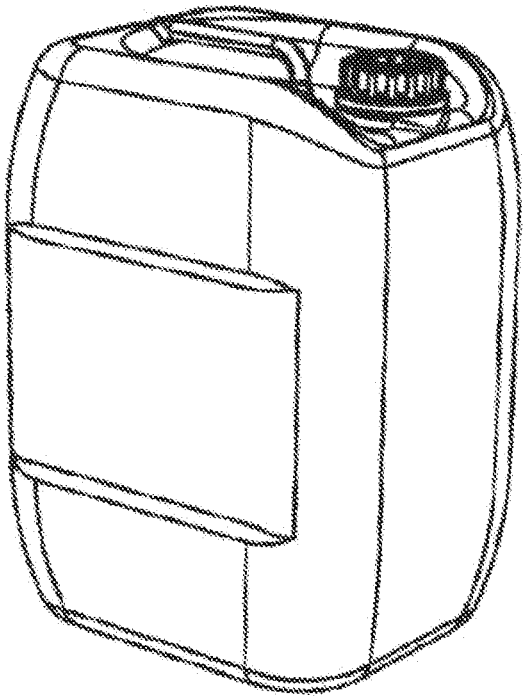
Figure 3:
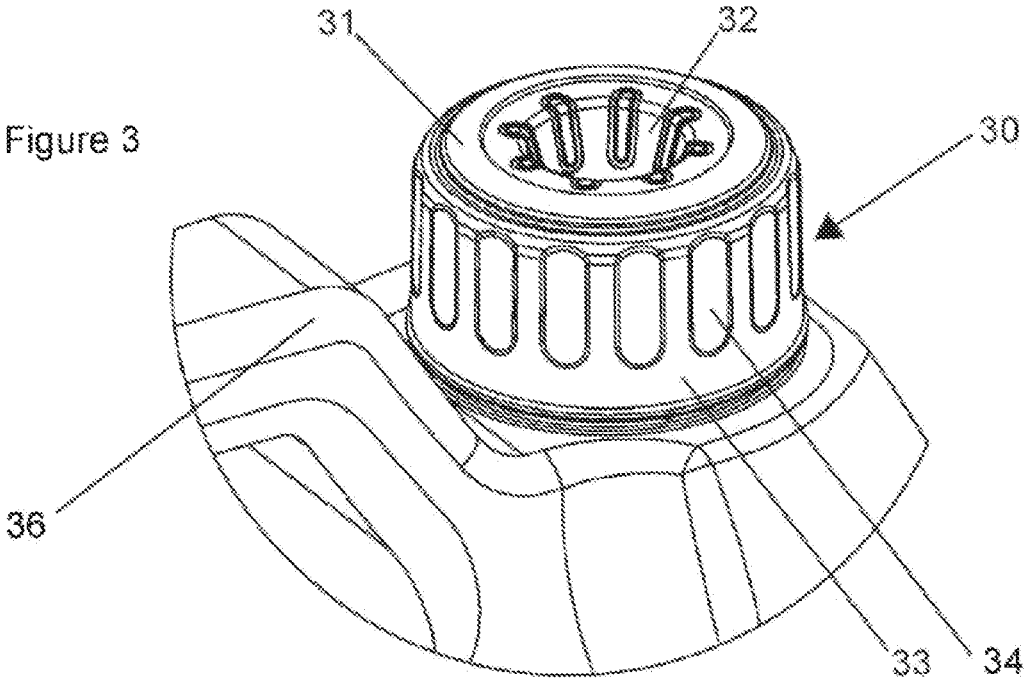
FIG. 3 shows a first embodiment of the invention placed upon a type of container as shown in FIG. 1.
Figure 4:
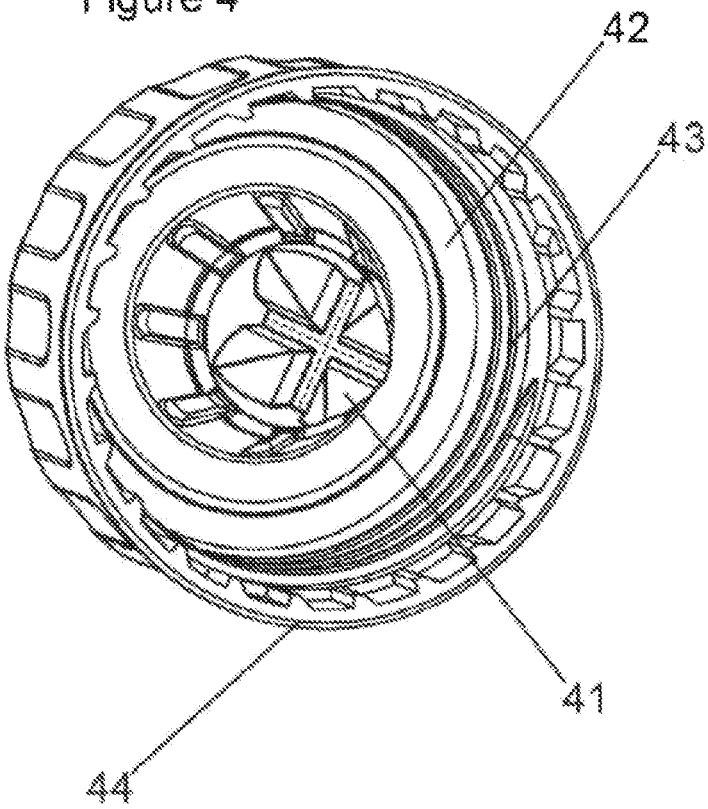
FIG. 4 shows an inside of the lid of FIG. 3, with FIG. 4*a* showing detent teeth on the neck of a container for engagement with teeth on the inside of the lid.
Figure 5:
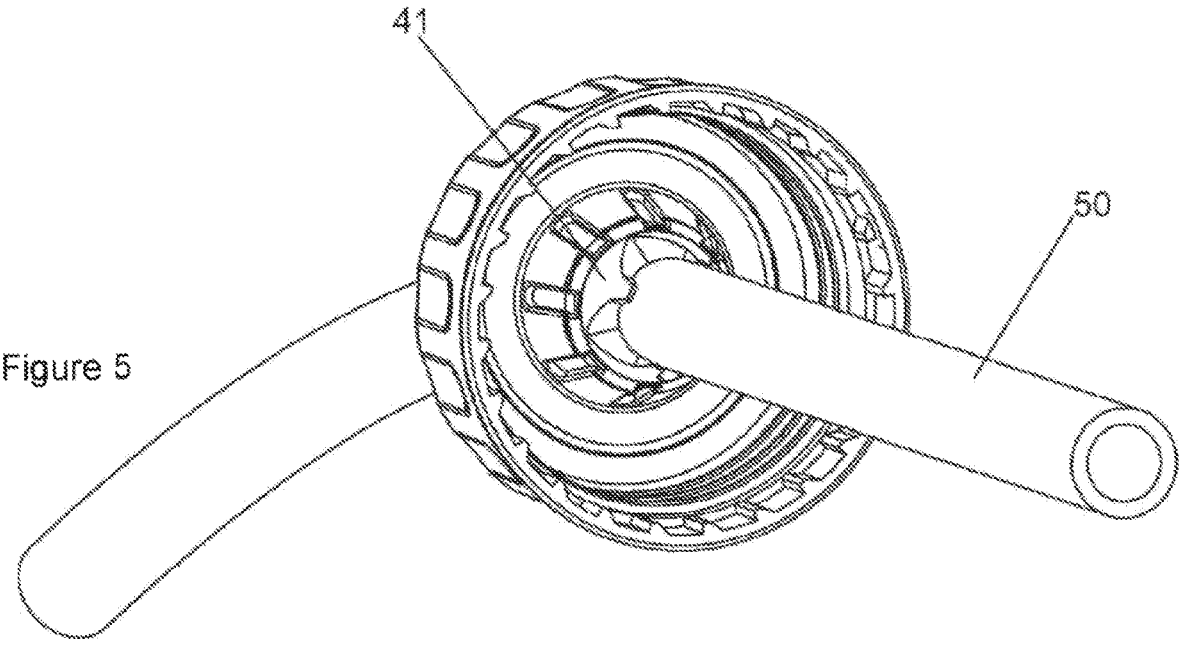
FIG. 5 shows an inside of the lid of FIG. 3, with a tube inserted therethrough.

Referring now to FIGS. 3, 4 and 5, there is shown a first embodiment of the invention. Apertured closure 30 is shown affixed to a standard five-liter container 36 as referred to in FIG. 1. The apertured closure has an inside seal member which abuts a rim of the opening of the container. Whilst the rim of the container is not shown, examples of such are well known, typically comprising a short length of generally circularly cylindrical wall about an aperture to the inside of the container, the outside wall having a screw-thread, which is inter-engageable with an inside wall of the apertured closure. Conveniently, the apertured closure 30 has a locking mechanism whereby once attached by way of the screw-thread fittings, removal of the apertured closure is not possible. One-way-detent systems—or barbed systems—are widely available for child-proof caps and the same detent release system can be adapted to ensure that no release is possible. A shroud may also depend from the wall of the apertured closure so that it is not possible to insert a tool to remove the cap, or at least not to enable removal and subsequent re-fitting, whereby to enable tampering to be determined. It is also possible to have the apertured closure attached by a push-on, non-releasable fashion as are also widely available. The apertured closure has a top outside face 31 with a central depression 32; along the outside wall of the apertured closure 33, there are provided knurled formations 34 which can be utilized to enable the cap to be securely fastened upon first use.

Figure 4A:
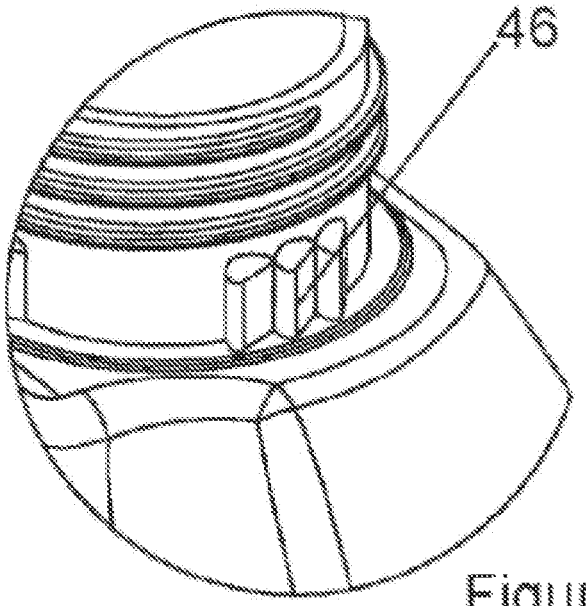

FIG. 4 shows a view of the inside of the apertured closure 30. The inside of central depression 32—as seen from the outside—extends inwardly of the inside of the apertured closure and comprises an aperture with a resilient seal member 41, shown here in a self-sealed, closed position. A perimeter inside seal member 42 is placed within the apertured closure whereby, in use and upon fastening of the apertured closure with respect to a container, a seal is created which prevents fluid seepage therebetween. The seal of aperture seal member 41 and inside seal member 42 are conveniently made from the same plastics material at the same time in an injection molding operation. The seal is conveniently manufactured from a thermoplastics rubber such as nitrile butadiene rubber, but compatibility/suitability of such a seal must be determined with reference to the fluid contained within the container. Nitrile butadiene rubber (NBR) typically comprises a family of unsaturated copolymers of 2-propenenitrile and various butadiene monomers (1,2-butadiene and 1,3-butadiene) and the specific physical and chemical properties vary depending on the polymer's composition of nitrile, this form of synthetic rubber being generally resistant to oil, fuel, and other chemicals (the more nitrile within the polymer, the higher the resistance to oils but the lower the flexibility of the material), with a typical usable temperature ranges of −40° C. to 108° C. Neoprene could also be chosen, for example; there are many other types of suitable materials. The inside wall of the apertured closure defines an internal thread 43, which corresponds with the outside thread of a container with which the container is to seal with respect to an upper sealing edge of a container opening and to which the apertured closure is associated. Reference numeral 44 indicates one-way security detent teeth, which are arranged around the inside of the apertured closure and co-operate with corresponding detent teeth associated with the container. In this case, the container is a standard 5-liter container with the detent teeth indicted at reference 46 per FIG. 4*a*—arranged for use with elastic "squeeze-release" child-proof caps. In contrast with such caps, the present invention provides an apertured closure or cap which does not provide any give arising from any inherent flexibility nor any frangibility—some known tamper-evident caps operate in such a fashion, whereby to ensure that once an apertured closure in accordance with the invention has been placed upon the container, it cannot be removed. FIG. 5 shows the apertured closure with a plastics tube 50 inserted and retained by the seal member 41.

The present invention, in a first embodiment, therefore enables the insertion of a delivery tube into a container such as an injection molded semi-rigid lid with a threaded outlet. In this first embodiment, when the apertured closure is fitted and a tube inserted, then the fluid can be dispensed. In a cleaning department store, for example, the container will be attached to a bench or wall, to reduce chances of a container being dropped etc. in use. The dispensing tube can be easily inserted and the use of the apertured closure will prevent the contents of the bottle leaking or spilling from the apertured closure, whilst the tube associated with a vacuum dispensing apparatus will allow control of the fluid to be dispensed, rather than the whole container being decanted by hand, with or without a measuring cup or similar. After the fluid in the container has been removed, as the tube is extracted, any remaining fluid adhering to the tube will substantially be removed by the valve of the closure wiping around the tube, assisting in keeping the area of use, and the assembly itself, in as clean a state as possible. The inside wall depending from the apertured closure central area component includes an internal screw thread allowing the lid to attach to a standard blow molded container. The semi-rigid lid includes barbed features on the inside of its internal rim. When the apertured closure is fitted to the bottle and screwed into position, the barbed features locate over existing barbed features positioned on the neck of the blow-molded bottle. Because of the orientation of the barbed features they act to lock the apertured closure in place, preventing the apertured closure from being unscrewed from the blow-molded bottle. It will be appreciated that push-on apertured closures which have a hooked flange which locate about corresponding detents associated with a neck of an outlet of the container are also possible, although by use of a pre-existing screw-threaded outlet for a container, then correct fastening can be simply ensured.

The semi-rigid lid molding acts as a pre-form component allowing a flexible polymer to be over-molded onto the lid. The semi-rigid lid includes a central open aperture into which a diaphragm is molded in the flexible material. The diaphragm is of a specific shape, which will allow a tube to be inserted from the outside of the lid into the bottle, but not from the other direction, since the entrance to the diaphragm seal is tapered. When the tube is removed the diaphragm closes preventing the liquid in the bottle from leaking. The shape of the diaphragm follows the form of a slit valve, such as a duckbill or cross slit valve. A cross slit valve, when viewed from the underside the diaphragm forms a cross shape. The shoulders of the cross-like membrane taper up to the diaphragm body at an angle. When liquid held inside the container applies pressure to the valve, the liquid acts on these angled faces pressing the valve closed and acting to reduce the likelihood of spillage of the contents from the container. The cross-like membrane creates four indented features in the conical shape of the diaphragm. These have a central crease line where the faces of the cross-form meet. When a tube is passed through the diaphragm from the outside, these features fold outwards allowing the diaphragm to open and grip the outside of the tube. When the tube is withdrawn from the bottle, the indented features naturally return to their original molded shape, so that the integrity of the cross slit valve form is maintained. Tri-star slit valves also exist, as do valves with more than four slits (i.e. cross slit). Such slit valves are, in essence, check valves that can be precision-molded, one-piece elastomeric valves that provide reliable backflow prevention at low-pressure differentials—that is to say, with reverse flow, a negative differential pressure is created whereby backflow is checked. Slit check valves can straightforwardly be designed to start functioning at specific closing pressure ranges, dependent on specific requirements, and arising from valve size, geometry, and compound characteristics. Slit check valves can be designed to operate in pressures as low as a few millimeters of water.

Figure 6:
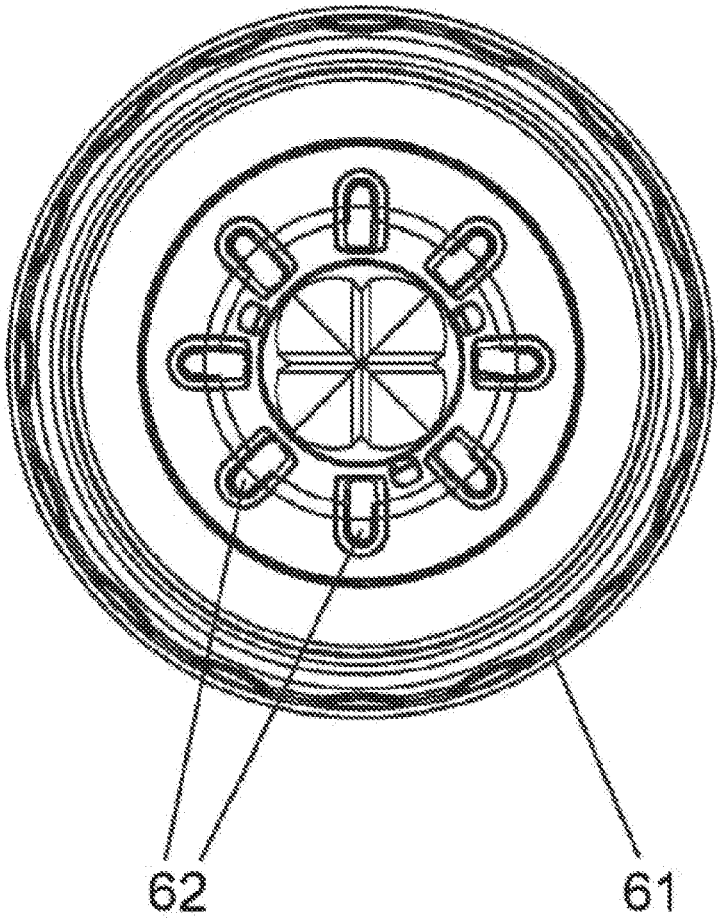
FIGS. 6 and 7 show first and second views of an outside top of a first embodiment.
Figure 7:
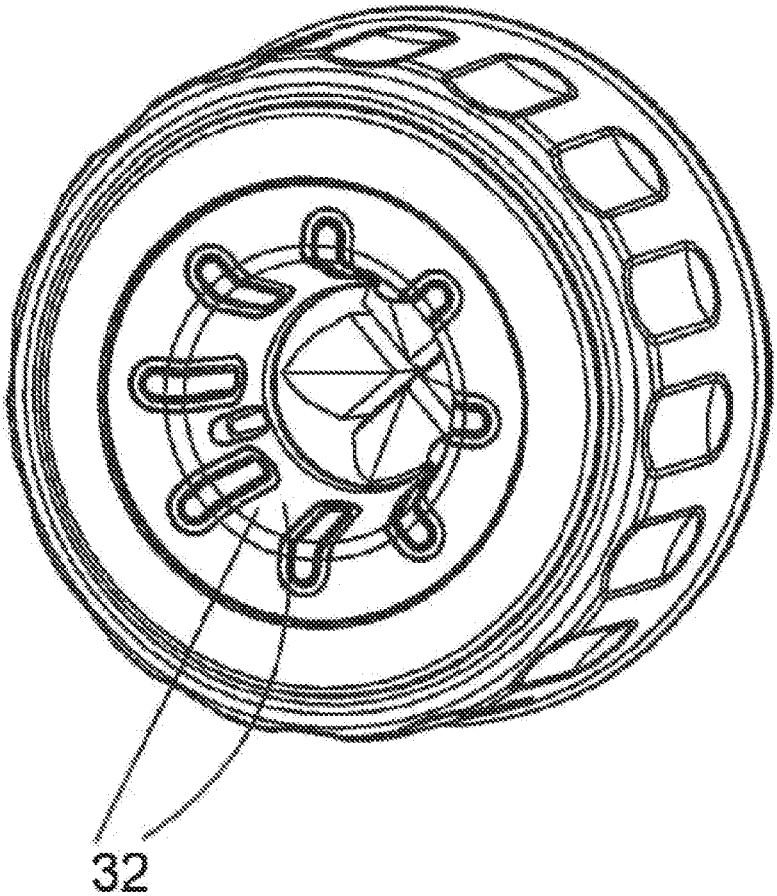
Figure 8:
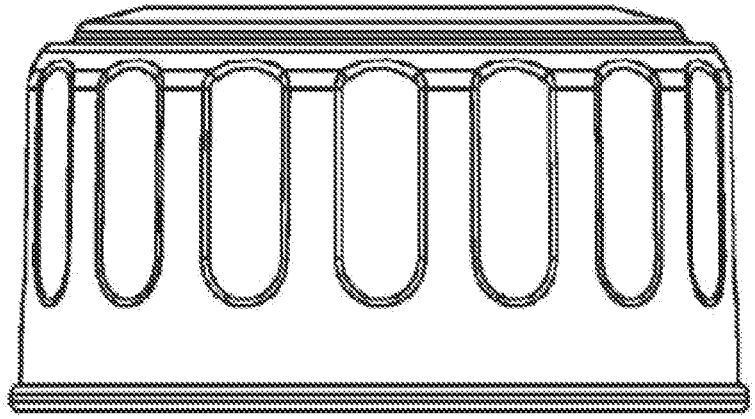
FIG. 8 shows a side view of the first embodiment in profile.

Referring now to FIGS. 6, 7, and 8, the container cap is shown in plan, perspective and side views, respectively. FIGS. 6 and 7 show the central indentation 32, which is manufactured from a resilient plastics material. It will be noted that there is a spoke-like pattern 62 radiating from the depression area, which comprise apertures defined in the semi-rigid cap member 61; not only does this provide a pattern—which can help identification of particular fluids if supplied in different colors, but also assist in a mechanical bonding of the resilient plastics material to the semi-rigid apertured closure. The outer, semi-rigid lid (i.e. less resilient than the central resilient plastics material can be manufactured from a material such as high density polyethylene (HDPE) or polypropylene, and similar plastics materials. It will be appreciated that other materials, such as brass, aluminum alloys and other metals could also be utilized to fabricate the semi-rigid cap member.

Figure 9:
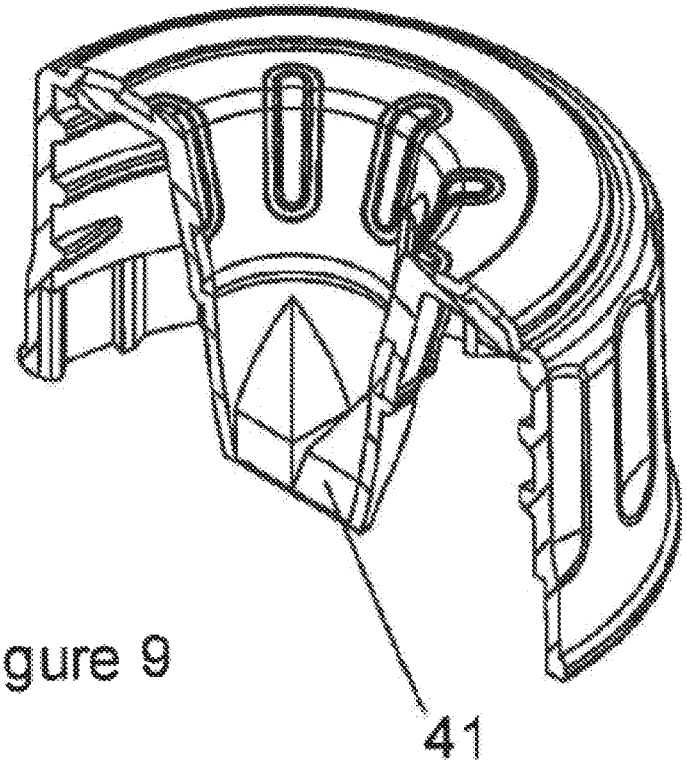
FIG. 9 shows an apertured closure in section.
Figure 10:
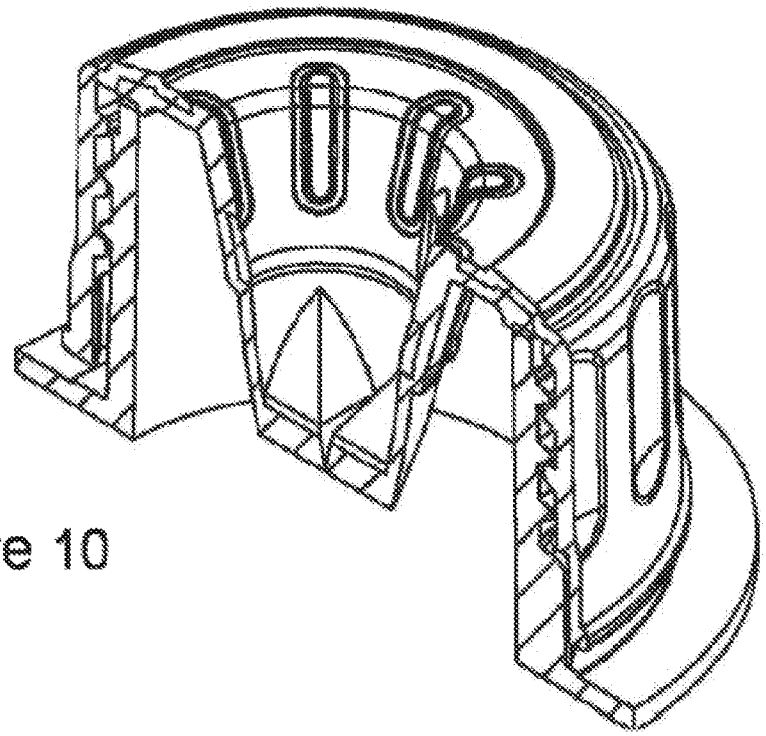
FIG. 10 shows an apertured closure when mated to a container top in section.

Reference is now made to FIGS. 9 and 10, which show an apertured closure in cross-section, with FIG. 10 also including the aperture part of the container or bottle. Valve 41 can be seen in greater detail, which loosely surrounds the tube inserted therethrough, yet only allows air to pass into the container as fluid is dispensed therefrom. Given that dispensing means typically use vacuum forces to enable passage of fluid, a partial vacuum within the container will reduce the amount of a dispensed quantity. A gastight seal may be provided as between a tube and the apertured closure, as might be required for certain classes of fluids, when the central seal is gastight. Accordingly, in addition to the valve as defined above for the tube, closely fitting O-rings may be secured, which O-rings create a fluid-tight seal, between aperture and tube. It will be appreciated that different seals will be required for specific tube diameters. Additionally, a one way valve will need to be provided to enable air to enter the closed volume of the container whereby to prevent vacuum problems arising in any dispensing of fluid.

Figure 11:
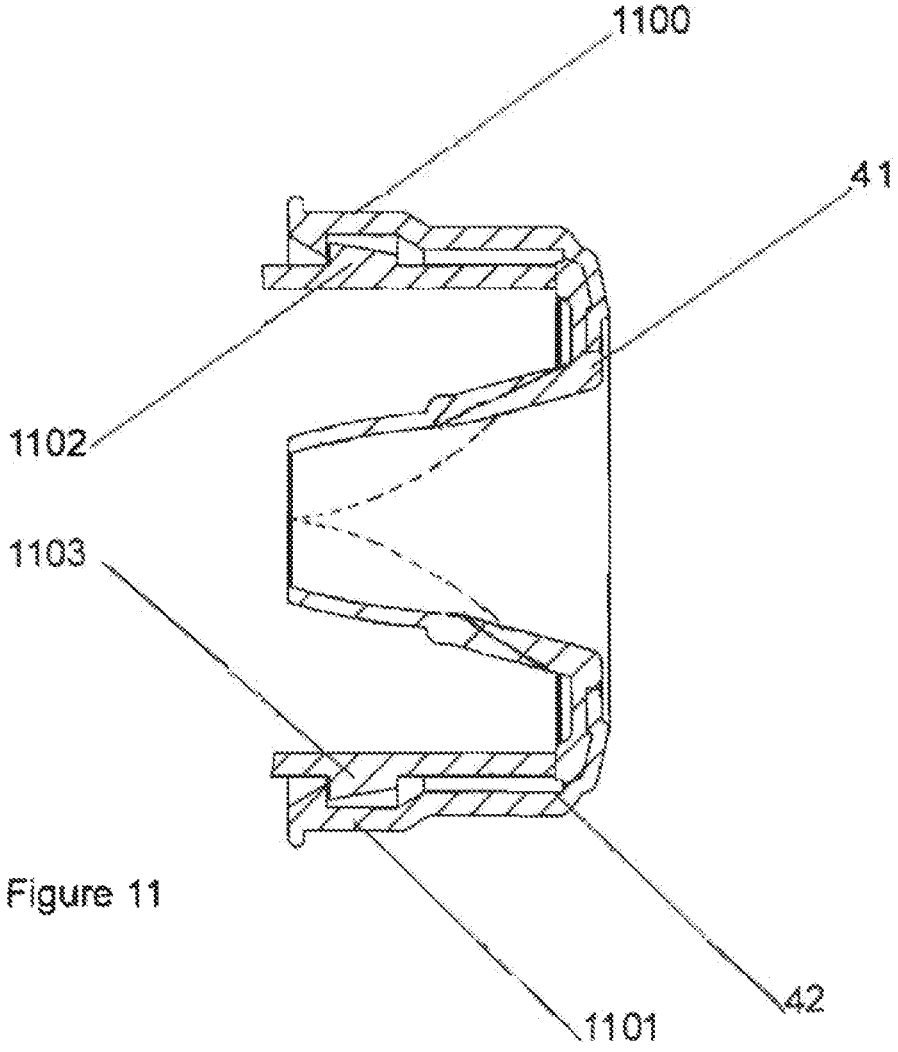
FIG. 11 shows a variant apertured closure retaining system.
Figure 12:
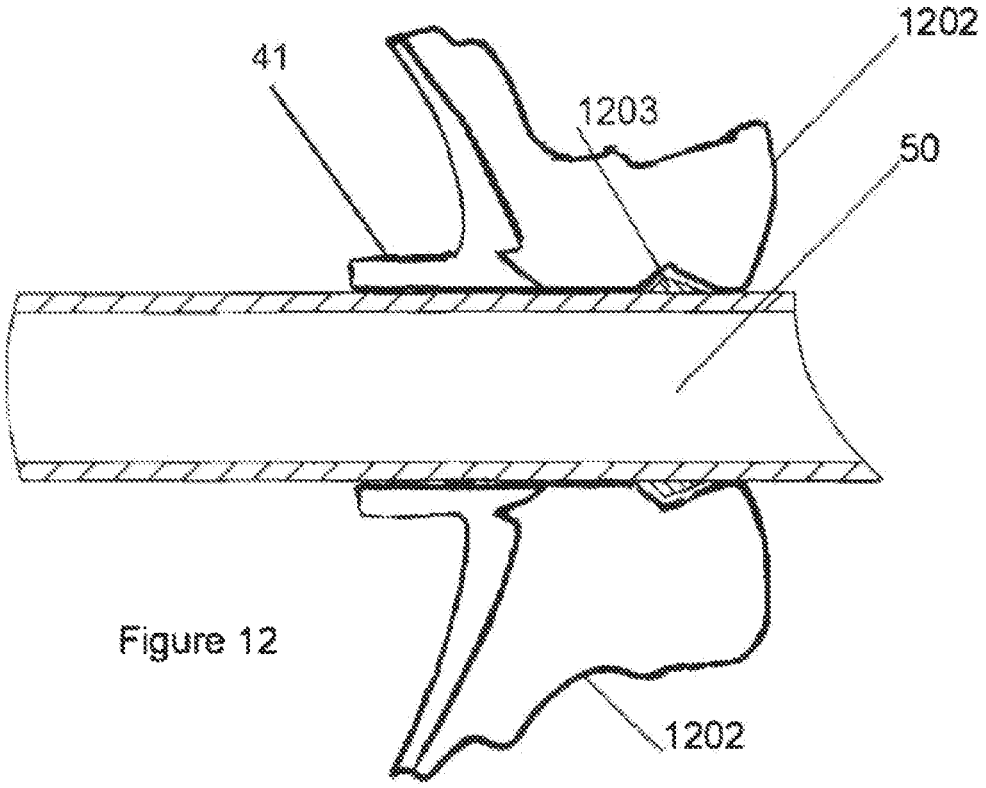
FIG. 12 shows an additional sealant system that locates about a tube.

Referring now to FIG. 11, there is shown a further variation. Apertured closure 30 has on interior walls a detent mechanism indicated at 1100, 1101. The valve remains the same, with seal member 41, inside rim seal 42. Instead of an exterior screw thread on the outside neck of the container, second detent elements are shown, 1102, 1103. FIG. 12 shows a still further variant, being a close-up of the indented element, but not details of the cap-to-container connection. In this case, a tube 50 is sealing engaged with respect to the inlet by close fitting body of the apertured closure 1202, aided by a wedge-section seal element 1203. Additional non-return spikes (not shown) may be placed to prevent removal of the tube, for example if the product was particularly hazardous. Since this embodiment sealingly engages around the tube 50, a separate inlet valve must be provided within the apertured closure, or additionally with respect to the container, unless, of course the dispensing tube also carries a separate line, which ensures that an appropriate degree of relative vacuum is maintained within the gaseous space of the container. Reference numeral 41 indicates the seal per FIGS. 4 and 5 that is displaced when the tube is inserted, which seal enables sealing of the contents of the container, once in place and prior to insertion of the tube.

A container may be supplied with an apertured closure in accordance with the present invention, in which case the apertured closure may be adhesively fastened to the container. A stopper-like element may be provided within the aperture, whereby to prevent loss of fluid in transit. By the use of a suitable adhesive tape, the apertured closure may be retained. In the alternative a twisted wire-seal fastener, in the style of a champagne cork fastener may be utilized. Other securing mechanisms could be deployed.

Figure 12A:
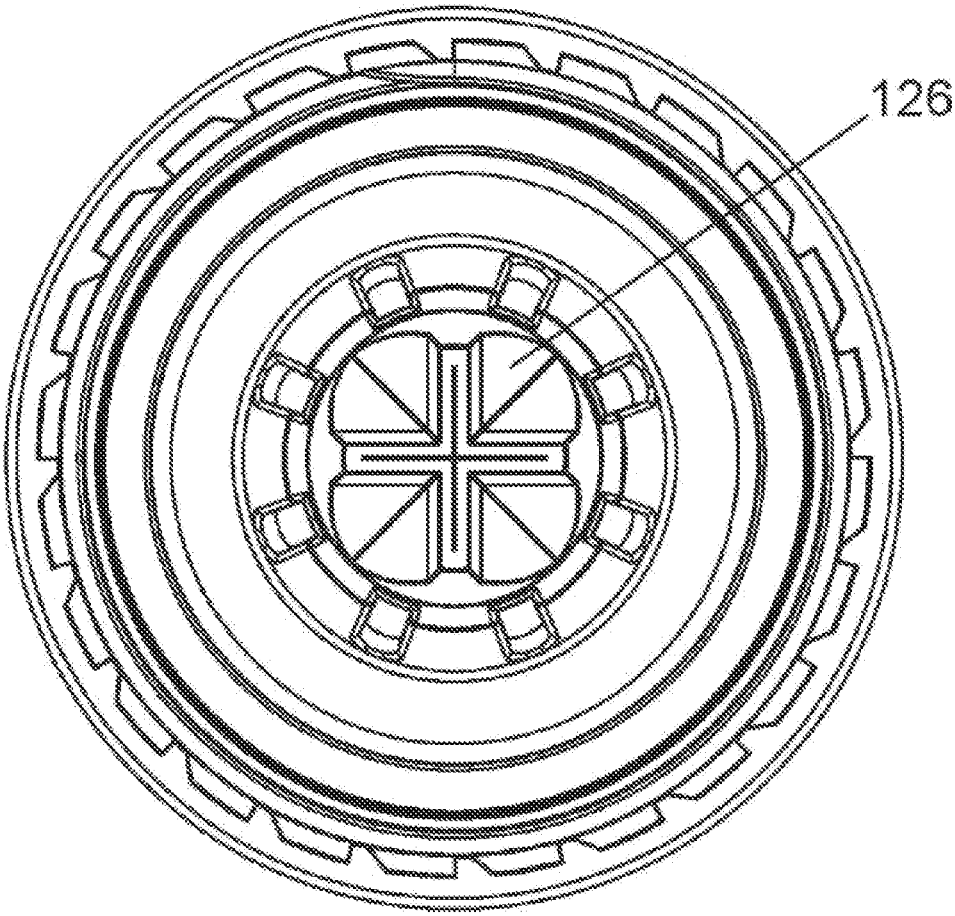
Figure 12B:
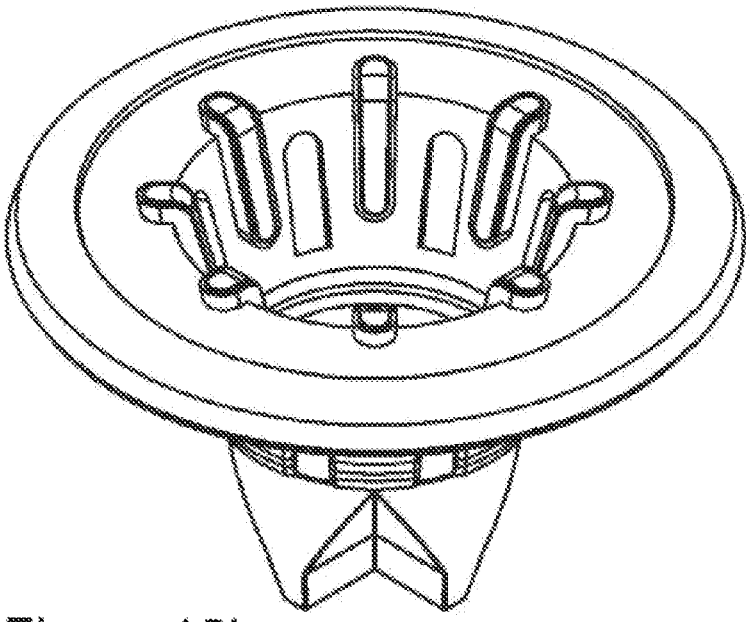
Figure 12C:
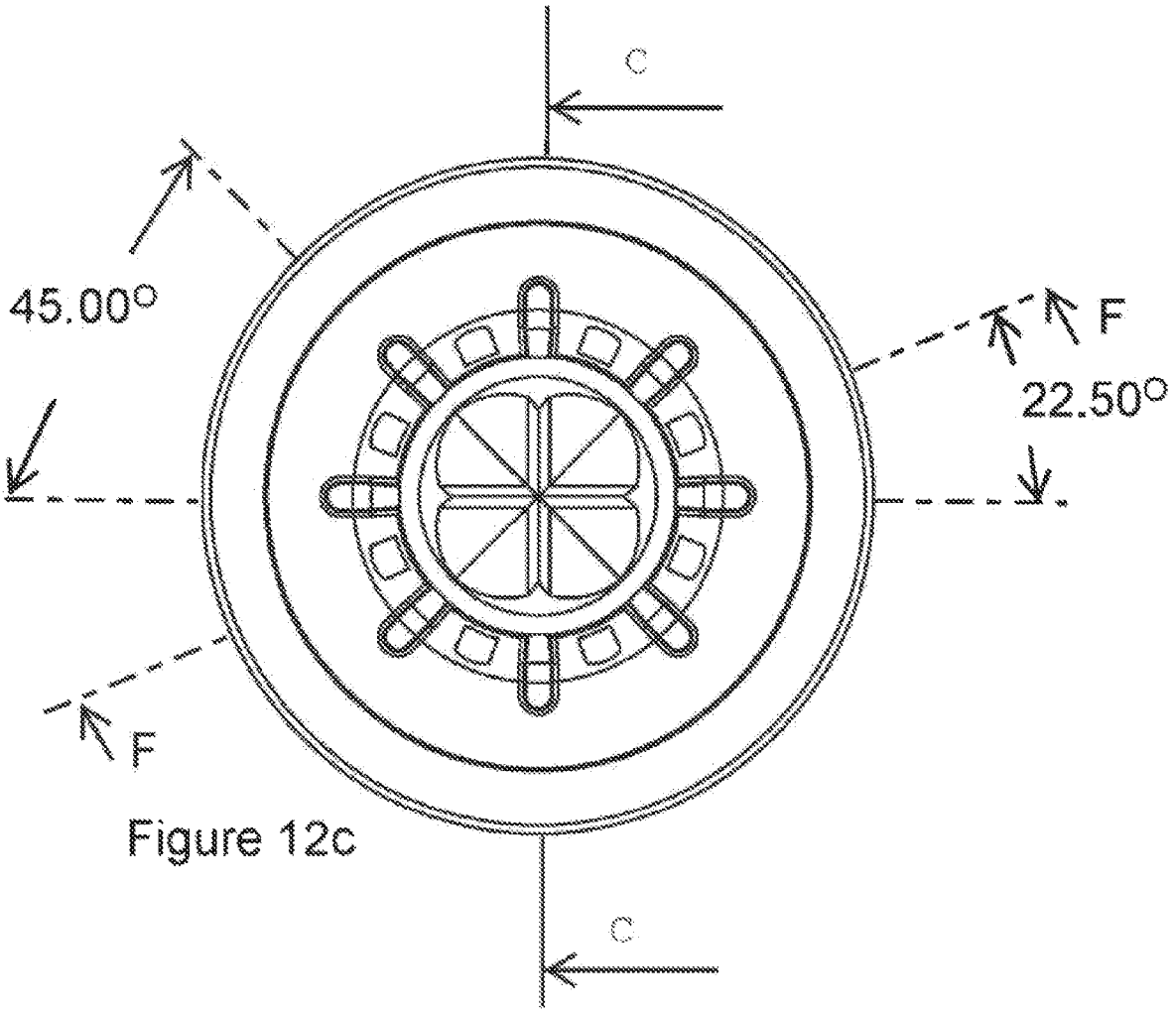
Figure 12D:
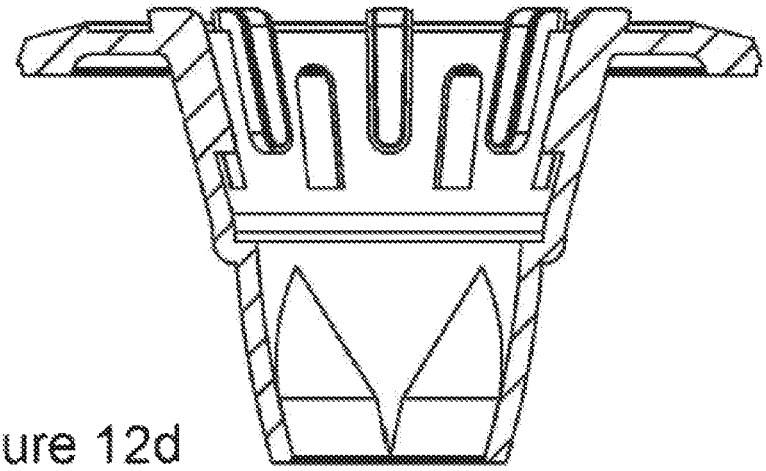
Figure 12E:
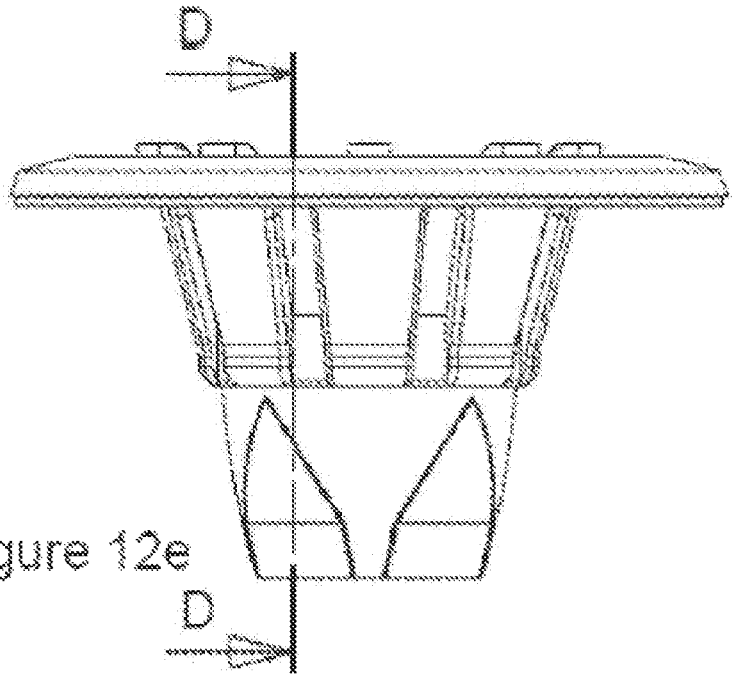
Figure 12F:
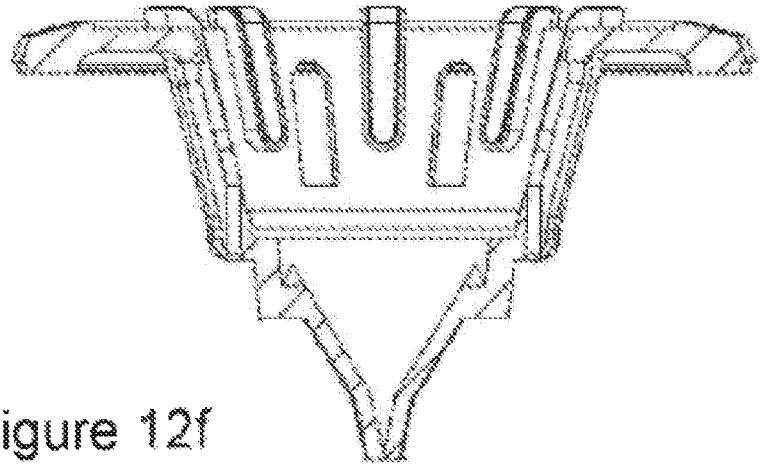

Referring back to FIG. 4, the aperture valve conveniently comprises a cross-slit valve; FIG. 12*a* is a plan view of the cross-slit valve 126, being an opposite face of the closure as seen in FIG. 6. FIGS. 12*b* and 12*c* shows the aperture valve—made from an elastic plastics material, such as a thermoplastic elastomer, in perspective and plan views, respectively, separate from the outer, harder plastics molding—conveniently made from a plastics material such as polypropylene of the closure. Other materials are known to the person skilled in the art. FIG. 12*d* is a sectional view on line C-C of FIG. 12*c*. FIG. 12*f* is a sectional view on line D-D of FIG. 12*e*. As is known, thermoplastic elastomer, bonds well to polypropylene, the injection molding being conveniently performed in a manual or automated twin shot injection process, as is known. Other suitable materials that may be used can be silicon rubber, natural rubber, polybutylene, ABS polymers which have suitable elasticity values and may be formed with additives such as lubricants to control the friction of the plastics material so that it is appropriate to the liquid contained and tube employed to enable flow of liquid from the container.

Figure 12G:
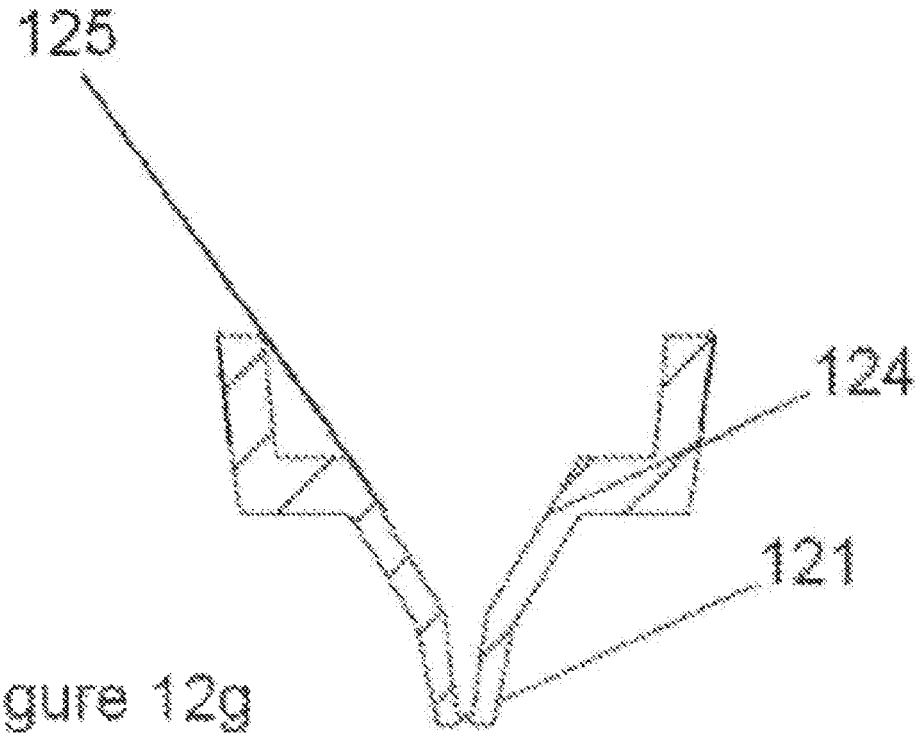
Figure 12H:
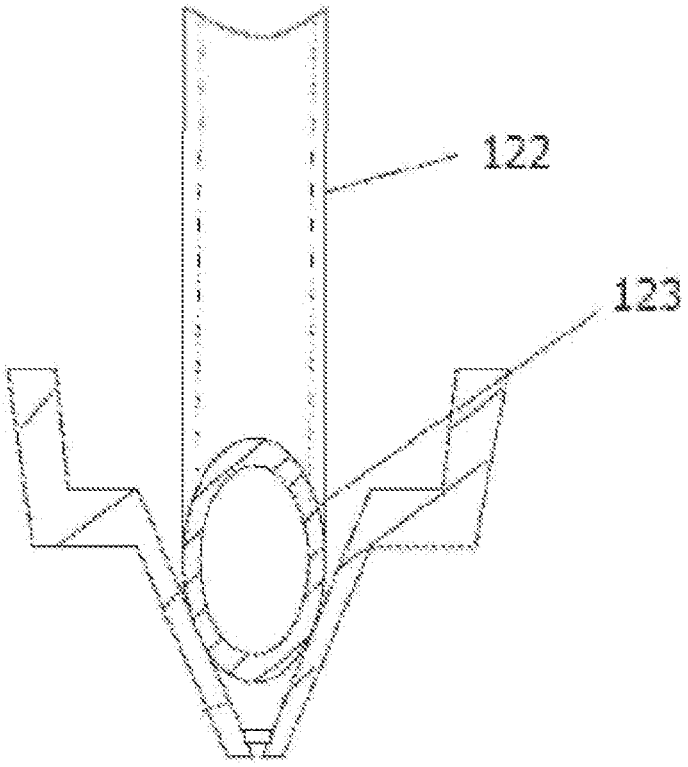
Figure 12I:
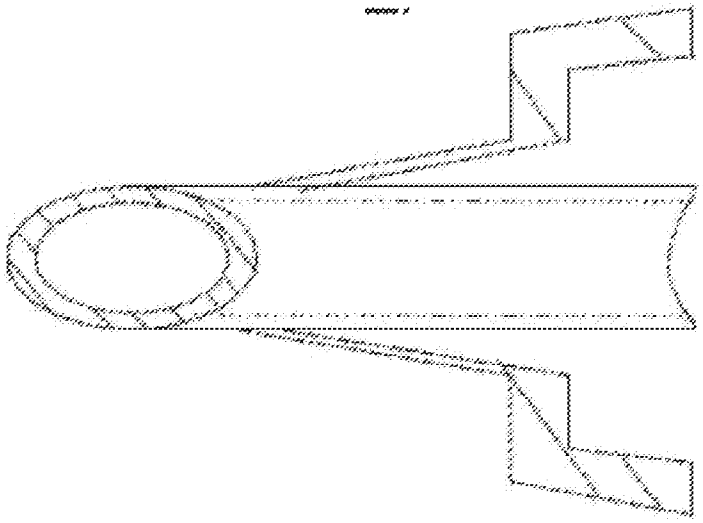
Figure 12J:
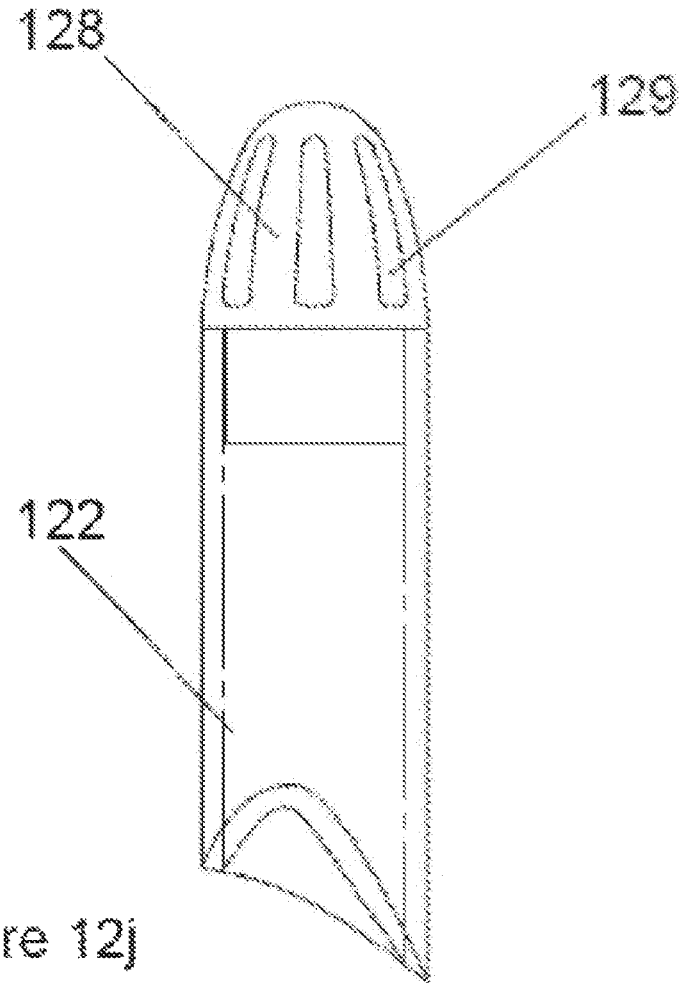

It is convenient to mold the aperture valve such that the valve is sealed in a closed state upon manufacture. This provides surety against spillage when the aperture closure in accordance with the present invention is fastened to a container with a fluid therein yet has not been used. Conveniently, the valve member is sealed adjacent a peripheral edge of the cross slit 120 per FIGS. 4, 12*a*, 12*c*, etc., the connecting member being indicated by reference numeral 121. With reference to FIGS. 12*g*-12*h*, there is a valve 124, 125 defining a slit 121; as a tube 122 having a diagonally cut end 123, is brought onto the flared upper surfaces of the valve, 124, 125, the slit is separated. With reference to FIG. 12*i*, the tube has caused the polymeric material to separate at the thin bonded region 121 and the peripheral edges of the valve engage with the external surface of the tube. Alternatively, there may be for example, an inverted v-profile lower edge of the valve, the slit being made either as part of the molding process or as an extra process step in manufacture. This V-notch slit aids the tearing of the membrane of the valve whilst inserting a conduit, although the presence of such a slit is dependent upon size of aperture valve and the materials employed. Upon insertion of a tube for a first time, the mold line of the valve is forced apart, without detriment to the future sealing ability of the valve. That is to say, in this further embodiment, the aperture valve of the closure can be produced so as to be sealed before initial insertion of a tube or conduit for the purpose of transportation and conformity. It has been found that the tube is preferably cut diagonally with respect to the axis of conduit for the tube or a tip element is fastened to the tube, whereby to facilitate insertion of the tube. With reference to FIGS. 12*h* and 12*i*, the tube is shown as having been cut diagonally at the insertion end. With reference to FIG. 12*j*, tube 122 could have an apertured end closure element 128 fitted on the end of a tube that has been cut normally with respect to the radial axis of the tube. This apertured end also benefits from having a number of openings 129 for fluid transfer into the tube. By not having a single opening, then the chances of having that single opening closed by debris or by intimate contact with a container wall are removed. Additionally a non-return valve could be optionally associated with this tube termination.

It will be appreciated that whilst the first embodiment has been shown with reference to a five liter container, the apertured closure, flexible diaphragm with aperture can be made to in a range of sizes, to accommodate a number of standard diameter tubes and can be made with a bayonet style, clip-over style or screw-threaded whether it be left or right handed. It can be made for any size container and for any size of tube. Accordingly, for example, the container could be a twenty liter container or other commonly used container from which fluids need to be dispensed, provided that an outlet has a neck, screw-threaded or otherwise which the apertured closure or cap in accordance with the invention can locate. The connection of the apertured closure with respect to the container could also comprise a push-fit design with either a male or female clip design to suit a push fit design container as shown in diagram. Whilst most apertures tend to be circular in shape, by virtue of their having a circular, screw-threaded aperture, it will be appreciated that if a detent/clip system is employed, the aperture need not be circular and a square, rectangular, other polygonal or irregular shaped opening could be utilized. For example, the irregular shape may be provided so that for particularly hazardous fluids, then appropriate shape determinant closures are to be used with such classes of fluids. In an alternative scenario, a shape could be associated with a particular manufacturer of containers and apertured closures. It is conceivable that an outline of a logo of a manufacturer could define the shape of the opening and thus the corresponding apertured closure.

Referring now to FIGS. 13*a* and 13*b*, there is shown a variation of the valve, for use (typically, but not exclusively) with substantially rectangular tubes. FIG. 13*a* shows one side of a flap of valve 1301; FIG. 13*b* shows valve 1301 as would be seen from an inside of a container, prior to placement of the tube. Valve 1301 in this case is the simple single slit, two-flap duckbill valve. The lips of the flap are tapered in the same way as the cross slit valve described above and, in operation, utilizes a pressure of liquid acting upon it to cause the valve to close. Other types of unidirectional or non-return valves are known, for examples conical valves 1501 and 1502 shown in FIGS. 14 and 15.

With reference to FIGS. 16*a*-16*b*, a further type of apertured closure are shown with a strain relief member that is operable to urge a tube that is introduced to enter the valve substantially centrally into the seal-aperture, whereby undue forces do not cause the tube to lie in a position other than being substantially axial with respect to a central axis of the aperture. Strain relief element 1701 comprises an apertured membrane, having an aperture 1702 larger than a tube intended to pass through the seal-orifice: the strain relief element providing a more rugged aperture against which forces arising from a tube, often several meters long and liquid filled, bearing upon the aperture seal.

FIGS. 17*a*-17*c* show, respectively, a second type of strain relief member in perspective, cross-sectional and perspective cross-sectional views of an iris diaphragm the iris diaphragm element 1704 comprising resiliently-biased elements 1705 which seek to reduce the aperture so-formed 1706, as is known, the element being sufficiently rugged to bear weight arising from a tube being directed through the sealed orifice of the present invention.

Figure 1C:
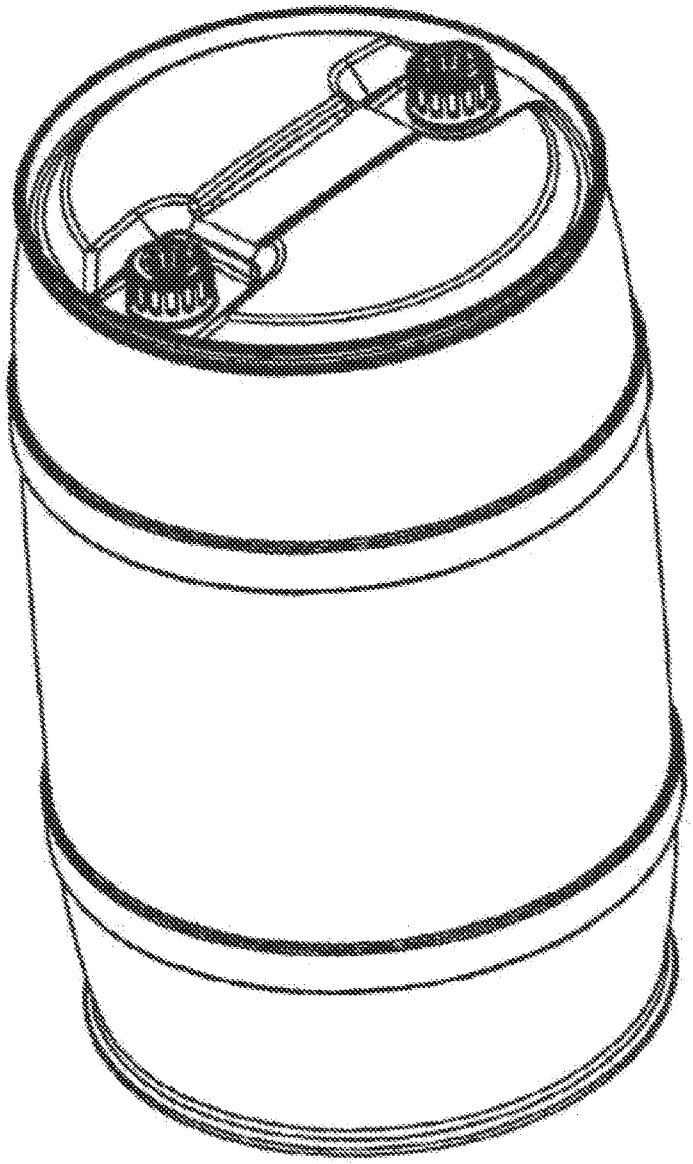
Figure 2:
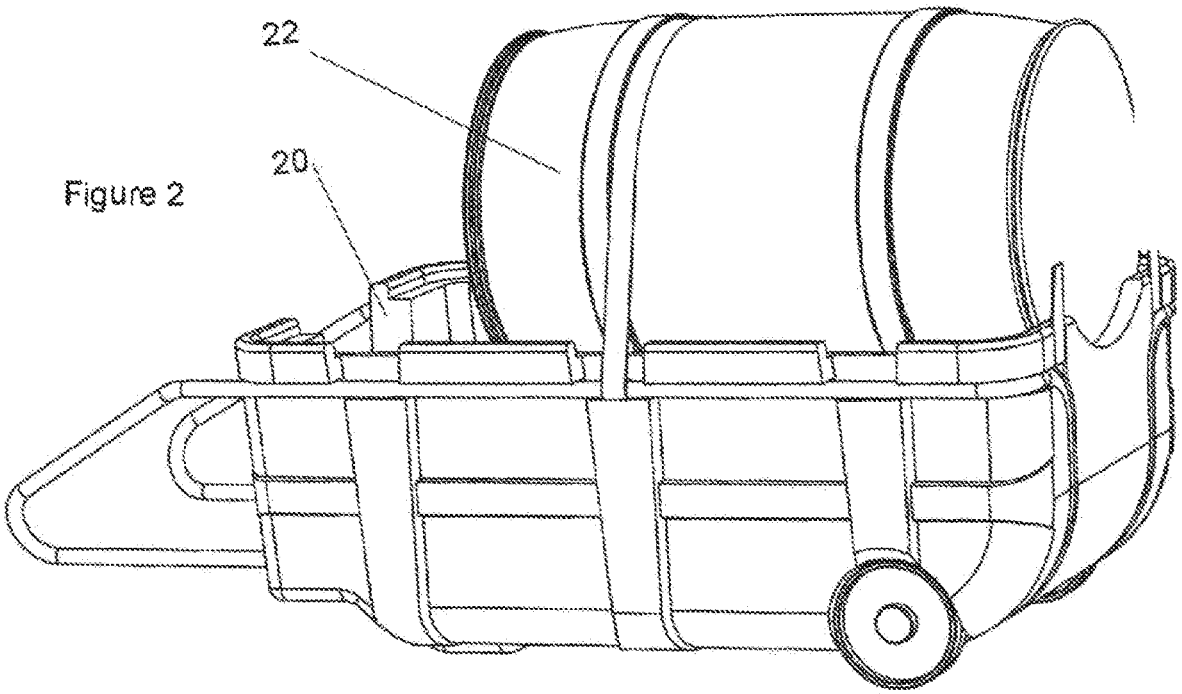
FIG. 2 (PRIOR ART) illustrates a further prior art container, upon a support.
Figure 18A:
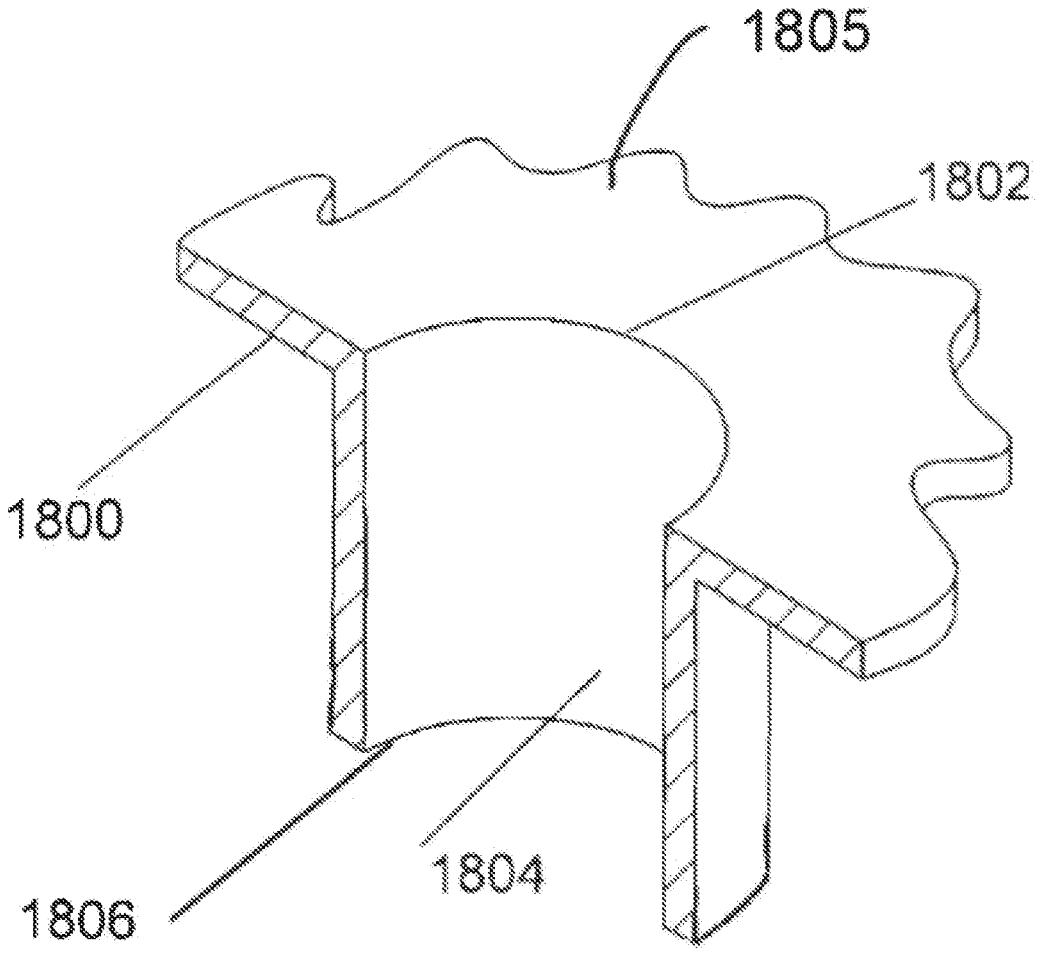
Figure 18B:
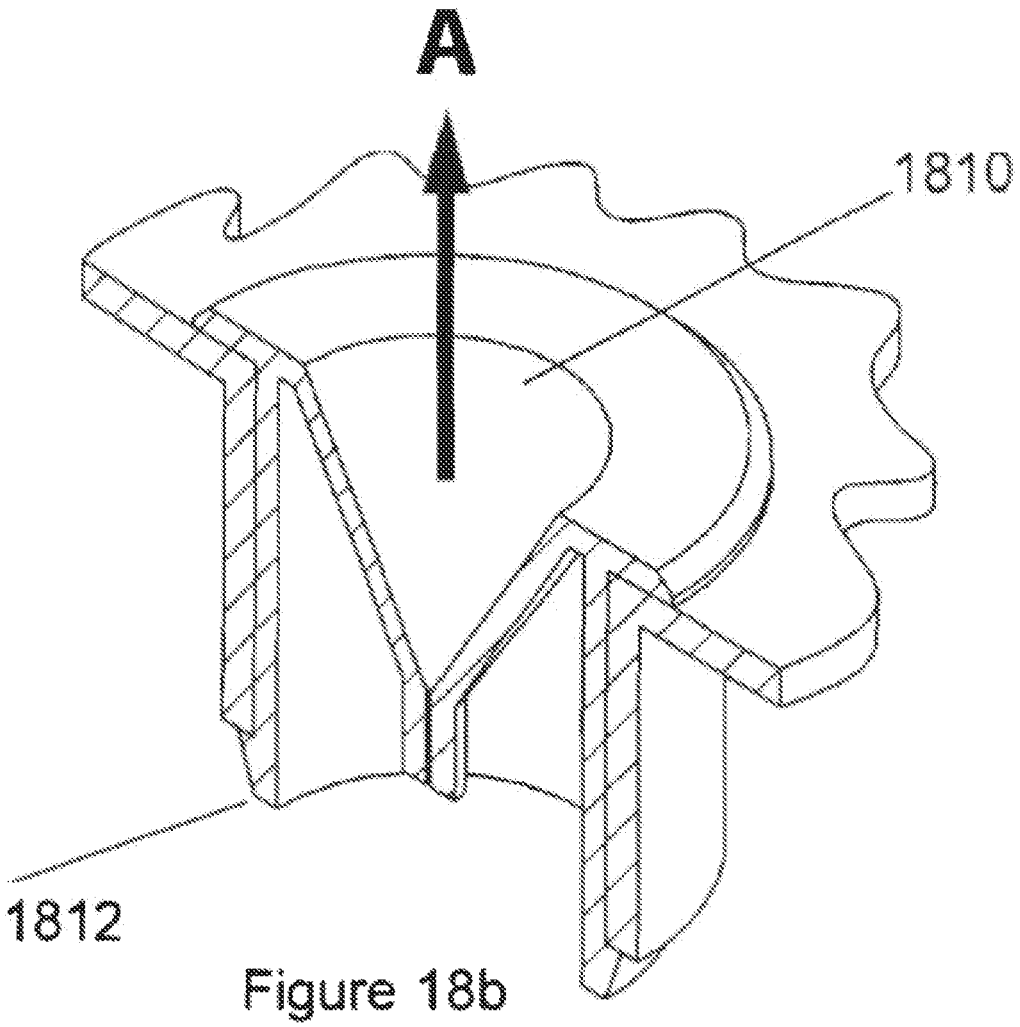
Figure 18C:
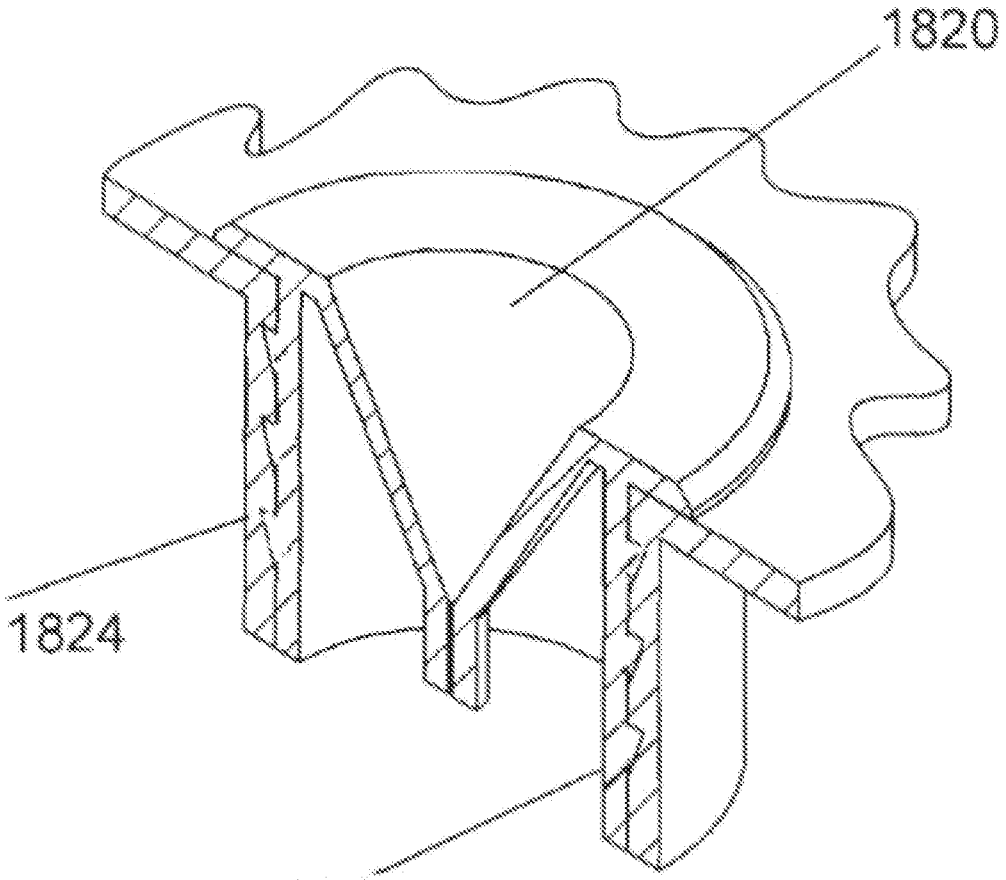

FIG. 18*a* shows an opening 1802 in a container 1800 such as the one depicted in FIG. 1*c*. The opening 1802 is shown in cross-section and is defined by a tube section 1804 depending from an outside wall 1805 of the container. The lower edge of the tube defines a rim 1806. FIG. 18*b* shows a first style of apertured closure 1810 for such a female opening engagement in accordance with the invention; the apertured closure device comprises a plastics body that has reverse-oriented lips 1812, which depend upon the rim 1806. In the event any forces are brought axially though the opening (in a direction indicated by arrow A), then any further movement will be prevented or at least limited. For such a design, it would be appropriate to have a female opening 1802 having a length in general correspondence with the length of the insert. With regard to FIG. 18*c*, barbs 1824 are arranged upon an external surface 1822 of the insertion part of the closure device 1820. Upon any movement to remove the closure device, the barbs will drive into the inside wall of the opening; thereby limiting any further movement of the closure device form the opening.

Figure 18D:
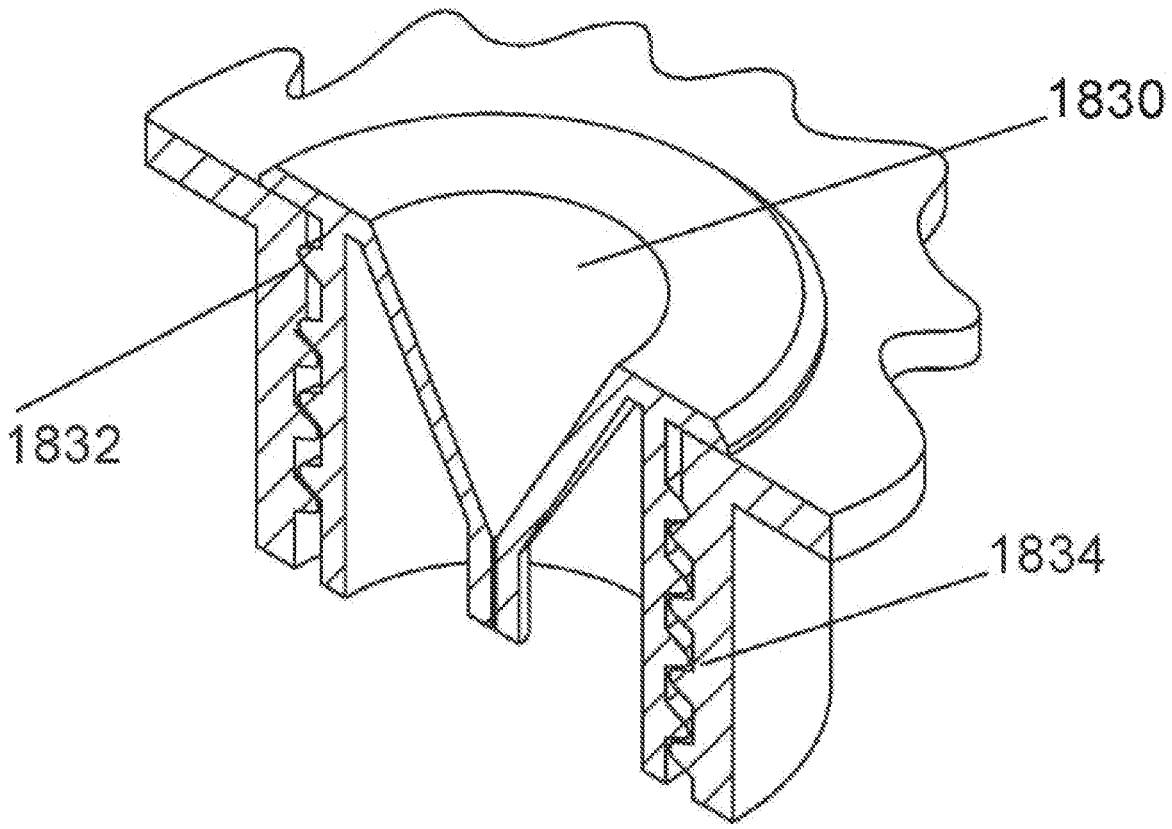
Figure 18E:
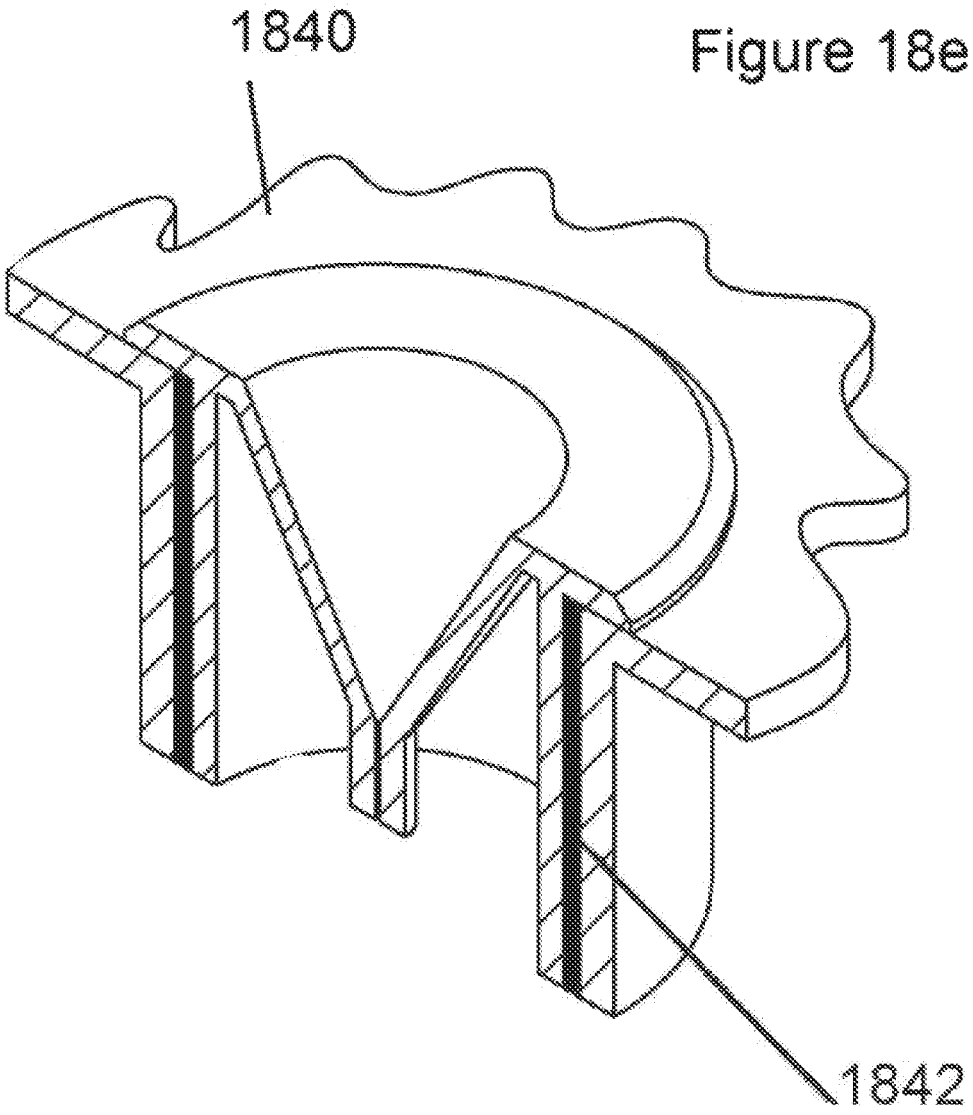

FIG. 18*d* shows a third style of apertured closure 1830; barbs 1832 together with a self-tapping screw thread 1834 enable the apertured closure device to be fastened irreversibly; the barbs, parallel spaced with respect to the screw-thread prevent any undoing of the closure device. Upon any movement to remove the closure device, the barbs will drive into the inside wall of the opening; thereby limiting any further movement of the closure device from the opening. With regard to FIG. 18*e*, the shaft of the closure device 1840 is coated with an adhesive 1842 to prevent separation once inserted into the opening 1804. Equally, a heating system could be utilized to heat weld thermo-plastics components together. It will be understood that the skilled man will be knowledgeable of similar methods of forming permanent connection between a closure device and an opening.

FIG. 19 shows a more sophisticated mechanical one-way closure system without detail of the aperture 1908, wherein an apertured closure 1900 is provided with an inner cap 1902 which has a plurality of triangular saw tooth projections 1904 located on its outer surface 1905 and an outer cap 1906 which fits over and rotates relative to the inner cap 1902 and is provided with knurled features 1907 located on its inner surface. The knurled features 1907 of the outer cap are complementary to and angled the same way as the saw tooth projections 1904 of the inner cap so that when the outer cap is rotated in the opening direction, the knurled features 1907 will move freely or ratchet over the saw tooth projections 1904. In contrast, when the closure system is placed upon an opening having a complementary screw thread, then the knurled features 1907 cam against the saw toothed projections 1904 causing the caps to rotate in unison and engage with the container.

As will be appreciated, in a still further embodiment, the apertured closure could be provided with thread cutting barbs, whereby to screw-threadedly engage with an opening, whether it be an external circumference (male) or an internal tube (female) opening.

FIG. 20 shows a further alternative system, wherein a bung 2000 is inserted into an apertured closure 2002 after a container has been emptied of fluid, so that the container with remnants of fluid can be disposed of safely, without unnecessary leaks, after a dispensing conduit has been removed from the container. As will be appreciated, the bung can be secured in a number of fashions, screw threads, extending barbs, adhesive, etc. The bung may also be placed within the aperture (but not in an irreversible fashion) prior to first use to ensure that the apertured closure is maintained as clean as possible prior to first use.

FIG. 21*a* shows a still further embodiment of the invention, wherein closure 210 is suitable for fitment to sports drink containers, for example. A straw can be inserted into the aperture 211 of the closure. FIG. 21*b* shows a cover 212 overlying the aperture, prior to or after use with a straw, whereby dust, dirt or other materials cannot enter the valve assembly when the straw is absent. It will be realized that the materials used in the manufacture of the cap and container will be food grade and that any mold release residue will be washed or otherwise removed from the aperture closure cap. It will be appreciated that variations of this will enable food grade containers to be used for dispensing comestible sauces, creams, pastes, such as ketchups, mustard, mayonnaise etc., conveniently for use with a dispenser means having a siphon or vacuum arrangement. By the use of the present invention, sports drink manufacturers can provide drinks that cannot be tampered with, which has been of some concern with some athletes, notably with professional cyclists. FIG. 21*c* shows a drink container 214 fitted with the aperture cap 210 together with a straw 213 in place.

In a still further aspect of the invention, a tube and valve combination may be selected to provide an improved seal in use. For example, the tube may be dimensioned to correspond with a general n-flap duckbill valve by having n-super-elliptical portions. FIG. 22 shows such an embodiment 220 having two super-elliptical portions 221, 222 which are dimensioned to achieve liquid flow in the hollow center 226 flow with a maximum degree of sealing as between the elliptical wall portions of the tube 224, 225 and corresponding inside faces of a bi-flap duckbill. It will be appreciated that this design can more effectively seal with respect to the valve or enable the use of less resilient plastics tube for a particular requirement of sealing. The design can extend a tri-, quad-, penta-, etc. stars having Lame curve elliptical sections to correspond with trifold, quad-fold, penta-fold etc. duckbill seals. With reference to the super elliptic portion 221, this can be described as an area bounded in part by two oppositely directed Lame curves; for an n-fold duckbill the corresponding tube can have n-elliptical portions. It would be possible to provide a keyed tube—a tube having super-ellipse star configuration—for specialist fluids, for example, of a length sufficient to extend to ensure that maximum use of a fluid is removed from a container. One could also have a rigid or semi-rigid tube extension, which affixes to an ordinary tube, for specific specialist requirement, for example. Of course, basic polygonal shapes may also be employed. It will be appreciated that the use of the super-ellipse design together with the n-fold duckbill can be applied to the designs discussed above, in general. It will also be appreciated that the use of keyed tube-container aperture can be employed in addition to or separately from the use of color coding of lids, tubes, dispensing valves, so that certain types of fluids are always handled though the appropriate tubing, also color coded, if necessary.

FIG. 23 shows a still further embodiment of the invention with three internally directed fingers relating to tube stress reduction finger. FIG. 24*a* shows an alternative embodiment with eight stress reducing fingers. These fingers act to guide a tube such that a lack of resilience in the tube (e.g. it is stiff at ambient temperatures in the winter, then the insertion of a tube may cause the tube to go through the valve (not shown in FIGS. 23-24*b*) at an angle whereby full sealing of the valve about the tube could be compromised. By the provision of such stress reducing finger elements on the entry portion of the aperture, the tube is likely to be centered on entry to the valve to ensure satisfactory sealing, as is shown in FIG. 24B with the presence of a centrally placed tube 242.

In accordance with a still further aspect of the invention, the closure is provided with a dispensing device, whereby the container, once fitted with the closure and secured thereto is provided with a dispenser unit. The dispenser comprises a body which is provided with a valve, a tube, insertable through the apertured closure of the invention, the valve or other type of mechanism being operable to receive fluid from the tube and to allow a measured dose or flow therethrough, to an outlet, being a tube, spray nozzle or spout. The body of the dispenser unit conveniently being removably attached to the apertured closure and being shaped to engage with certain features of the apertured closure, perhaps by mutually arranged co-operating sets of screw threads, whereby, for example, a container with the apertured closure may have a dispenser removably associated therewith.

The invention provides a simple to fabricate container stopper, which can enable satisfaction of health and safety requirements that are imposed on all types of businesses and increases compliance. Within the EU, for example, there is an Ecolabel scheme that provides accreditation. The scheme involves certification as well as compliance checks by independent, qualified scientists, and is trusted by consumers. This, in turn, means that a business can sell its products across the European Union and in other countries where such accreditations are considered equivalent to other national standards. In so doing, a business can more easily be focused on its primary aims, adding value to a business and its products because it increases reputation, indicates corporate social responsibility and increases sales. The present invention, by assuring economical use of liquid products can help a company achieve such accreditation and corresponding accreditations elsewhere.

The skilled person will be aware of a range of possible modifications of the various embodiments described above. Accordingly, the present invention is defined by the claims and their equivalents.

What is claimed is:

1. A non-removable container closure apparatus for dispensing of fluids through a dispensing tube, comprising:

a closure made of a rigid material, the closure comprising an external convex surface, an internal concave surface, a top face, a bottom edge, and an opening in the top face between the external convex surface and the internal concave surface, wherein the internal concave surface further comprises:

screw threads formed into the rigid material configured to tighten the closure onto a container with an aperture having matching screw threads; and a plurality of one-way security detent teeth arranged about the bottom edge of the closure and configured to engage in a ratcheting fashion with security detent teeth on the container;

a central depression made of a resilient plastics material, the central depression comprising an aperture with a cross-slit valve, wherein:

an opening of the cross-slit valve comprises a cross shape, the cross shape comprising faces;

wherein the cross-slit valve comprises four shoulders, each shoulder comprises an indented feature with a central crease line where the faces of the cross shape meet;

wherein the cross-slit valve is configured to surround a plastics tube inserted therethrough yet permit the passage of air into the container through the valve as fluid is dispensed through the plastics tube due to a pressure differential; and an opening at the top of the central depression corresponding to the opening in the top face of the closure;

wherein the central depression further comprises:

a pattern is formed into the central depression, the pattern radiating from the central depression and configured to assist in mechanical bonding of the resilient plastics material of the central depression to the closure; and a plurality of raised stress-reducing fingers extending radially from the interior surface of the central depression;

wherein the lower portion of the central depression further comprises a one-way valve configured to prevent outflow of substances from any container to which the closure is attached, but to allow insertion of dispensing tubes for dispensing of such substances through the top opening of the closure.

2. The container closure of claim 1, wherein the pattern radiating from the central depression and configured to assist in mechanical bonding of the resilient plastics material of the central depression to the closure is color coded.

* * * * *